US006966130B2

(12) United States Patent
Meschan

(10) Patent No.: US 6,966,130 B2
(45) **Date of Patent: *Nov. 22, 2005**

(54) PLATE FOR ATHLETIC SHOE

(75) Inventor: David F. Meschan, Greensboro, NC (US)

(73) Assignee: Akeva L.L.C., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/881,390

(22) Filed: Jun. 30, 2004

(65) Prior Publication Data

US 2004/0231192 A1 Nov. 25, 2004

Related U.S. Application Data

(63) Continuation of application No. 10/447,003, filed on May 28, 2003, which is a continuation of application No. 10/007,535, filed on Dec. 4, 2001, now Pat. No. 6,604,300, which is a continuation of application No. 09/641,148, filed on Aug. 17, 2000, now Pat. No. 6,324,772, which is a continuation of application No. 09/512,433, filed on Feb. 25, 2000, now Pat. No. 6,195,916, which is a continuation of application No. 09/313,667, filed on May 18, 1999, now Pat. No. 6,050,002, which is a continuation of application No. 08/723,857, filed on Sep. 30, 1996, now Pat. No. 5,918,384, which is a continuation-in-part of application No. 08/291,945, filed on Aug. 17, 1994, now Pat. No. 5,560,126, which is a continuation-in-part of application No. 08/108,065, filed on Aug. 17, 1993, now Pat. No. 5,615,497.

(51) Int. Cl.[7] ..... A43B 13/18

(52) U.S. Cl. ..... 36/25 R; 36/28; 36/37

(58) Field of Search ..... 36/37, 25 R, 15, 36/100, 105, 103, 42, 31, 35 R, 35 B, 27, 28

(56) References Cited

U.S. PATENT DOCUMENTS

| | | | |
|---|---|---|---|
| 48,682 | A | 7/1865 | Hayward et al. |
| 221,592 | A | 11/1879 | Mitchell et al. |

(Continued)

FOREIGN PATENT DOCUMENTS

| | | |
|---|---|---|
| CH | 434 029 | 10/1967 |
| DE | 648 339 | 7/1937 |

(Continued)

OTHER PUBLICATIONS

AVIA "Ultra Running" concepts dated Dec. 18, 1986.
AVIA "Heel Tension Member" technical drawings dated Jan. 9, 1987.
AVIA Arc Shoe (photo; bottom view); sold in 1989.

(Continued)

*Primary Examiner*—M. D. Patterson
(74) *Attorney, Agent, or Firm*—Martin & Ferraro, LLP

(57) ABSTRACT

A shoe including a plate capable of being deflected in a direction substantially perpendicular to the major longitudinal axis of the shoe. The plate includes at least one rib integral with at least a portion of the lower surface of the plate. A portion of the rib is exposed to and visible from outside the shoe.

68 Claims, 34 Drawing Sheets

U.S. PATENT DOCUMENTS

| | | | |
|---|---|---|---|
| 357,062 | A | 2/1887 | Buch |
| 485,813 | A | 11/1892 | Hooper |
| 537,492 | A | 4/1895 | Smith |
| 652,887 | A | 7/1900 | Butterfield |
| 674,636 | A | 5/1901 | Priestman |
| 789,089 | A | 5/1905 | Frank |
| 818,861 | A | 4/1906 | Beck et al. |
| 990,458 | A | 4/1911 | Scholl |
| 1,046,815 | A | 12/1912 | Lavoie |
| 1,062,338 | A | 5/1913 | Kane |
| 1,088,328 | A | 2/1914 | Cuccinotta |
| 1,112,635 | A | 10/1914 | May |
| 1,316,505 | A | 9/1919 | O'Neill |
| 1,318,247 | A | 10/1919 | Victor |
| 1,346,841 | A | 7/1920 | Padden |
| 1,366,601 | A | 1/1921 | Sellars |
| 1,371,339 | A | 3/1921 | Arntz et al. |
| 1,410,064 | A | 3/1922 | Hunt |
| 1,439,757 | A | 12/1922 | Redman |
| 1,439,758 | A | 12/1922 | Redman |
| 1,444,677 | A | 2/1923 | Fischer |
| 1,458,257 | A | 6/1923 | Van Melle |
| 1,479,773 | A | 1/1924 | Craig |
| 1,501,765 | A | 7/1924 | Freese |
| 1,516,384 | A | 11/1924 | Kamada |
| 1,542,174 | A | 6/1925 | Robidoux |
| 1,611,024 | A | 12/1926 | Grimaldi |
| 1,625,048 | A | 4/1927 | Nock |
| 1,721,714 | A | 7/1929 | Ross |
| 1,811,641 | A | 6/1931 | Marcelle |
| 2,002,087 | A | 5/1935 | Esterson |
| 2,003,646 | A | 6/1935 | De Blasio |
| 2,078,311 | A | 4/1937 | Boag |
| 2,119,807 | A | 6/1938 | Farley |
| 2,148,974 | A | 2/1939 | Wysowski |
| 2,208,260 | A | 7/1940 | Hayden |
| 2,288,168 | A | 6/1942 | Leu |
| 2,300,635 | A | 11/1942 | Shepherd |
| 2,348,300 | A | 5/1944 | Klaus |
| 2,374,954 | A | 5/1945 | Pipitone |
| 2,403,442 | A | 7/1946 | Klaus |
| 2,446,627 | A | 8/1948 | Bier |
| 2,447,603 | A | 8/1948 | Snyder |
| 2,464,251 | A | 3/1949 | Moody |
| 2,491,280 | A | 12/1949 | Roth |
| 2,500,302 | A | 3/1950 | Vicente |
| 2,508,318 | A | 5/1950 | Wallach |
| 2,540,449 | A | 2/1951 | Kaufmann |
| 2,556,842 | A | 6/1951 | Gilmour |
| 2,607,134 | A | 8/1952 | Langer |
| 2,628,439 | A | 2/1953 | Rochlin |
| 2,707,341 | A | 5/1955 | Romano |
| 2,745,197 | A | 5/1956 | Holt |
| 2,806,302 | A | 9/1957 | Sharpe |
| 2,998,661 | A | 9/1961 | Israel |
| 3,083,478 | A | 4/1963 | Rakus |
| 3,085,359 | A | 4/1963 | Rubens |
| 3,087,265 | A | 4/1963 | McKinley |
| 3,169,327 | A | 2/1965 | Fukuoka |
| 3,171,218 | A | 3/1965 | D'Urbano |
| 3,208,163 | A | 9/1965 | Rubens |
| 3,237,321 | A | 3/1966 | McKinley |
| 3,271,885 | A | 9/1966 | McAuliffe |
| 3,318,025 | A | 5/1967 | Antelo |
| 3,432,158 | A | 3/1969 | McMahon et al. |
| 3,455,038 | A | 7/1969 | Kasdan |
| 3,478,447 | A | 11/1969 | Gilead |
| 3,514,879 | A | 6/1970 | Frattalone |
| 3,566,489 | A | 3/1971 | Morley |
| 3,593,436 | A | 7/1971 | Vietas |
| 3,646,497 | A | 2/1972 | Gillikin |
| 3,664,041 | A | 5/1972 | Frattalione |
| 3,775,874 | A | 12/1973 | Bonneville |
| 3,782,010 | A | 1/1974 | Frattallone |
| 3,804,099 | A | 4/1974 | Hall |
| 3,928,881 | A | 12/1975 | Bente |
| 3,988,840 | A | 11/1976 | Minihane |
| 4,043,058 | A | 8/1977 | Hollister et al. |
| 4,062,132 | A | 12/1977 | Klimaszewski |
| 4,067,123 | A | 1/1978 | Minihane |
| 4,098,011 | A | 7/1978 | Bowerman |
| 4,102,061 | A | 7/1978 | Saaristo |
| 4,168,585 | A | 9/1979 | Gleichner |
| 4,198,037 | A | 4/1980 | Anderson |
| 4,214,384 | A | 7/1980 | Gonzalez |
| 4,224,749 | A | 9/1980 | Diaz-Cano |
| 4,224,750 | A | 9/1980 | Delport |
| 4,258,480 | A | 3/1981 | Famolare, Jr. |
| 4,262,434 | A | 4/1981 | Michelotti |
| 4,263,728 | A | 4/1981 | Frecentese |
| 4,267,650 | A | 5/1981 | Bauer |
| 4,288,929 | A | 9/1981 | Norton et al. |
| 4,317,293 | A | 3/1982 | Sigle et al. |
| 4,320,588 | A | 3/1982 | Sottolana |
| 4,322,894 | A | 4/1982 | Dykes |
| 4,322,895 | A | 4/1982 | Hockerson |
| 4,342,158 | A | 8/1982 | McMahon et al. |
| 4,363,177 | A | 12/1982 | Boros |
| 4,372,058 | A | 2/1983 | Stubblefield |
| 4,377,042 | A | 3/1983 | Bauer |
| 4,378,643 | A | 4/1983 | Johnson |
| 4,391,048 | A | 7/1983 | Lutz |
| 4,393,605 | A | 7/1983 | Spreng |
| 4,399,620 | A | 8/1983 | Funck |
| 4,414,763 | A | 11/1983 | Bente |
| 4,429,474 | A | 2/1984 | Metro |
| 4,449,307 | A | 5/1984 | Stubblefield |
| 4,455,765 | A | 6/1984 | Sjosward |
| 4,455,766 | A | 6/1984 | Rubens |
| 4,486,964 | A | 12/1984 | Rudy |
| 4,492,046 | A | 1/1985 | Kosova |
| 4,510,700 | A | 4/1985 | Brown |
| 4,530,173 | A | 7/1985 | Jesinsky, Jr. |
| 4,534,124 | A | 8/1985 | Schnell |
| 4,541,185 | A | 9/1985 | Chou |
| 4,546,556 | A | 10/1985 | Stubblefield |
| 4,550,510 | A | 11/1985 | Stubblefield |
| 4,561,195 | A | 12/1985 | Onoda et al. |
| 4,566,206 | A | 1/1986 | Weber |
| 4,592,153 | A | 6/1986 | Jacinto |
| 4,598,487 | A | 7/1986 | Misevich |
| 4,606,139 | A | 8/1986 | Silver |
| 4,608,768 | A | 9/1986 | Cavanagh |
| 4,610,099 | A | 9/1986 | Signori |
| 4,610,100 | A | 9/1986 | Rhodes |
| 4,622,764 | A | 11/1986 | Bouler |
| 4,638,575 | A | 1/1987 | Illustrato |
| 4,642,917 | A | 2/1987 | Ungar |
| 4,680,876 | A | 7/1987 | Peng |
| 4,706,392 | A | 11/1987 | Yang |
| 4,709,489 | A | 12/1987 | Welter |
| 4,712,314 | A | 12/1987 | Sigoloff |
| 4,741,114 | A | 5/1988 | Stubblefield |
| 4,745,693 | A | 5/1988 | Brown |
| 4,756,095 | A | 7/1988 | Lakic |
| 4,776,109 | A | 10/1988 | Sacre |
| 4,778,717 | A | 10/1988 | Fitchmun |
| 4,785,557 | A | 11/1988 | Kelley et al. |
| 4,811,500 | A | 3/1989 | Maccano |
| 4,815,221 | A | 3/1989 | Diaz |
| 4,843,737 | A | 7/1989 | Vorderer |
| 4,843,741 | A | 7/1989 | Yung-Mao |
| 4,845,863 | A | 7/1989 | Yung-Mao |
| 4,866,861 | A | 9/1989 | Noone |
| 4,875,300 | A | 10/1989 | Kazz |
| 4,878,300 | A | 11/1989 | Bogaty |
| 4,879,821 | A | 11/1989 | Graham et al. |
| 4,881,329 | A | 11/1989 | Crowley |
| 4,887,367 | A | 12/1989 | Mackness et al. |
| 4,936,028 | A | 6/1990 | Posacki |

| | | | |
|---|---|---|---|
| 4,979,319 | A | 12/1990 | Hayes |
| 4,995,173 | A | 2/1991 | Spier |
| 5,005,300 | A | 4/1991 | Diaz et al. |
| 5,014,449 | A | 5/1991 | Richard et al. |
| RE33,648 | E | 7/1991 | Brown |
| 5,052,130 | A | 10/1991 | Barry et al. |
| 5,068,981 | A | 12/1991 | Jung |
| 5,070,629 | A | 12/1991 | Graham et al. |
| 5,083,361 | A | 1/1992 | Rudy |
| 5,083,385 | A | 1/1992 | Halford |
| 5,086,574 | A | 2/1992 | Bacchiocchi |
| 5,092,060 | A | 3/1992 | Frachey et al. |
| 5,152,081 | A | 10/1992 | Hallenbeck et al. |
| 5,179,791 | A | 1/1993 | Lain |
| 5,185,943 | A | 2/1993 | Tong et al. |
| 5,191,727 | A | 3/1993 | Barry et al. |
| 5,197,206 | A | 3/1993 | Shorten |
| 5,220,737 | A | 6/1993 | Edington |
| 5,224,277 | A | 7/1993 | Sang Do |
| 5,255,451 | A | 10/1993 | Tong et al. |
| 5,279,051 | A | 1/1994 | Whatley |
| 5,297,349 | A | 3/1994 | Kilgore |
| 5,319,866 | A | 6/1994 | Foley et al. |
| 5,325,611 | A | 7/1994 | Dyer et al. |
| 5,343,639 | A | 9/1994 | Kilgore et al. |
| 5,353,523 | A | 10/1994 | Kilgore et al. |
| 5,363,570 | A | 11/1994 | Allen et al. |
| 5,367,792 | A | 11/1994 | Richard et al. |
| 5,381,608 | A | 1/1995 | Claveria |
| 5,402,588 | A | 4/1995 | Graham et al. |
| 5,425,184 | A | 6/1995 | Lyden et al. |
| 5,435,079 | A | 7/1995 | Gallegos |
| 5,461,800 | A | 10/1995 | Luthi et al. |
| 5,469,638 | A | 11/1995 | Crawford, III |
| 5,528,842 | A | 6/1996 | Ricci et al. |
| 5,560,126 | A | 10/1996 | Meschan et al. |
| 5,575,088 | A | 11/1996 | Allen et al. |
| 5,595,004 | A | 1/1997 | Lyden et al. |
| 5,615,497 | A | 4/1997 | Meschan |
| 5,685,090 | A | 11/1997 | Tawney et al. |
| 5,722,186 | A | 3/1998 | Brown |
| 5,806,210 | A | 9/1998 | Meschan |
| 5,829,172 | A | 11/1998 | Kaneko |
| 5,970,628 | A | 10/1999 | Meschan |
| 5,979,078 | A | 11/1999 | McLaughlin |
| 6,321,465 | B1 | 11/2001 | Bonk et al. |
| 6,662,471 | B2 | 12/2003 | Meschan |

FOREIGN PATENT DOCUMENTS

| | | |
|---|---|---|
| DE | 693 394 | 7/1940 |
| DE | 947 054 | 7/1956 |
| DE | 1 075 012 | 2/1960 |
| DE | 2 154 951 | 5/1973 |
| DE | 2 742 138 | 3/1979 |
| DE | 92 10 113.5 | 11/1992 |
| FR | 533 972 | 3/1922 |
| FR | 958766 | 3/1950 |
| FR | 2 507 066 | 12/1982 |
| GB | 21 594 | 8/1903 |
| GB | 25 728 | 11/1909 |
| GB | 3342 | 2/1911 |
| GB | 229 884 | 3/1924 |
| GB | 1 540 926 | 2/1979 |
| GB | 2 144 024 | 2/1985 |
| GB | 2 267 424 | 12/1993 |
| IT | 331247 | 10/1935 |
| JP | 33-9431 | 10/1958 |
| JP | 51-81145 | 12/1974 |
| JP | 57-12006 | 6/1980 |
| JP | 57-119704 | 7/1982 |
| JP | 59-137105 | 9/1984 |
| JP | 60-112902 | 7/1985 |
| JP | 61-149503 | 9/1986 |
| JP | 62-41601 | 10/1987 |
| JP | 62-200904 | 12/1987 |
| JP | 1-110301 | 4/1989 |
| JP | 5-18965 | 5/1993 |
| WO | WO 95/20333 | 8/1995 |

OTHER PUBLICATIONS

AVIA Arc Shoe (photo; cross section of heel); sold in 1989.
AVIA Arc Shoe (photo; bottom view with wave plate); sold in 1989.
AVIA Arc Shoe (photo; cross section of heel with wave plate); sold in 1989.
AVIA 1989 Catalog excerpt.
AVIA Fall 1991 Footwear Catalog.
Declaration of Jerry D. Subblefield dated Dec. 4, 2002.
Declaration of Takaya Kimura (Civil Action File No. 1:00 CV 00978).
Drawing of Mizuno shoe with plate and opening in bottom of shoe dated Jan. 3, 1991.
Expert Declaration of: Jerry D. Stubblefield dated Jul. 30, 2002.
Expert Declaration of: Jerry D. Stubblefield dated Oct. 7, 2002.
Etonic Spring Sport Shoe Catalog; p. 4; (1993).
Etonic Spring 1996 Footwear catalogue.
International Search for International Application PCT/US94/09001 dated Jan. 2, 1995.
Mizuno Sport Shoe Catalog (1986).
Mizuno 1985 Sports Shoe catalog excerpts (MIZJP 02524–02531).
Mizuno 1986 Sports Shoe catalog excerpts (MIZJP 02532–02537).
Mizuno 1987 Athletic Footwear catalog excerpts (MIZJP 02538–02546).
Mizuno 1987 Athletic Footwear catalog excerpts (MIZJP 02547–02549).
Mizuno 1991 All Line–Up catalog excepts (MIZJP 02550–02556).
Mizuno 1992 Run–Bird All Line–Up catalog excerpts (MIZJP 02557–02559).
Mizuno 1993 All–Line–Up catalog excerpts (MIZJP 02560–02564).
"New Footwear Concepts" by E.I. du Pont de Nemours & Co. (1988).
Report of Keith R. Williams with Exhibits A–G, dated Sep. 8, 2004.
Runner's World 1989 Spring Shoe Survey and ETONIC and AVIA advertisements (MIZ 135893–MIZ 135902).
TURNTEC 1993 Brochure (TURNTEC 93).
TURNTEC 1993 Brochure (TURNTEC 1993).
TURNTEC advertisement for "The Predator".
"TECHNOLOGY: Cushion of Steel puts the spring in high heels"; New Scientist; vol. 133, No. 1813; Mar. 21, 1992; pp. 1 and 22.
Turntec Brochure; The New State of the Art; American Sporting Goods Corp.
Affidavit of Jerry Turner dated Dec. 10, 2004; Akeva, L.L.C.v. Adidas America, Inc.; Civil Action No 1:03–cv–01207.

PLATE FOR ATHLETIC SHOE

This is a continuation of application Ser. No. 10/447,003, filed May 28, 2003; which is a continuation of application Ser. No. 10/007,535, filed Dec. 4, 2001, now U.S. Pat. No. 6,604,300; which is a continuation of application Ser. No. 09/641,148, filed Aug. 17, 2000, now U.S. Pat. No. 6,324,772; which is a continuation of application Ser. No. 09/512,433, filed Feb. 25, 2000, now U.S. Pat. No. 6,195,916; which is a continuation of application Ser. No. 09/313,667, filed May 18, 1999, now U.S. Pat. No. 6,050,002; which is a continuation of application Ser. No. 08/723,857, filed Sep. 30, 1996, now U.S. Pat. No. 5,918,384; which is a CIP of 08/291,945, filed Aug. 17, 1994, now U.S. Pat. No. 5,560,126; which is a CIP of 08/108,065, filed Aug. 17, 1993, now U.S. Pat. No. 5,615,497; all of which are incorporated herein by reference.

BACKGROUND OF THE INVENTION

1. Field of the Invention

The present invention relates generally to an improved rear sole for footwear and, more particularly, to a rear sole for an athletic shoe with an extended and more versatile life and better performance in terms of cushioning and spring.

2. Description of the Prior Art

Athletic shoes, such as those designed for running, tennis, basketball, cross-training, hiking, walking, and other forms of exercise, typically include a laminated sole attached to a soft and pliable upper. The laminated sole generally includes a resilient rubber outsole attached to a more resilient midsole usually made of polyurethane, ethylene vinyl acetate (EVA), or a rubber compound. When laminated, the sole is attached to the upper as a one-piece structure, with the rear sole being integral with the forward sole.

One of the principal problems associated with athletic shoes is outsole wear. A user rarely has a choice of running surfaces, and asphalt and other abrasive surfaces take a tremendous toll on the outsole. This problem is exacerbated by the fact that most pronounced outsole wear, on running shoes in particular, occurs principally in two places: the outer periphery of the heel and the ball of the foot, with peripheral heel wear being, by far, a more acute problem. In fact, the heel typically wears out much faster than the rest of a running shoe, thus requiring replacement of the entire shoe even though the bulk of the shoe is still in satisfactory condition.

Midsole compression, particularly in the case of athletic shoes, is another acute problem. As previously noted, the midsole is generally made of a resilient material to provide cushioning for the user. However, after repeated use, the midsole becomes compressed due to the large forces exerted on it, thereby causing it to lose its cushioning effect. Midsole compression is the worst in the heel area, including the area directly under the user's heel bone and the area directly above the peripheral outsole wear spot.

Despite technological advancements in recent years in midsole design and construction, the benefits of such advancements can still be largely negated, particularly in the heel area, by two months of regular use. The problems become costly for the user since athletic shoes are becoming more expensive each year, with some top-of-the-line models priced at over $150.00 a pair. By contrast, with dress shoes, whose heels can be replaced at nominal cost over and over again, the heel area (midsole and outsole) of conventional athletic shoes cannot be. To date, there is nothing in the art that successfully addresses the problem of midsole compression in athletic shoes, and this problem remains especially severe in the heel area of such shoes.

Another problem is that purchasers of conventional athletic shoes cannot customize the cushioning or spring in the heel of a shoe to their own body weight, personal preference, or need. They are "stuck" with whatever a manufacturer happens to provide in their shoe size.

Finally, there appear to be relatively few, if any, footwear options available to those persons suffering from foot or leg irregularities, foot or leg injuries, and legs of different lengths, among other things, where there is a need for the left and right rear soles to be of a different height and/or different cushioning or spring properties. Presently, such options appear to include only custom-made shoes that are prohibitively expensive and rendered useless if the person's condition improves or deteriorates.

SUMMARY OF THE INVENTION

The present invention is directed to a shoe that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the shoes and shoe systems particularly pointed out in the written description and claims, as well as the appended drawings.

To achieve these and other advantages and in accordance with one embodiment of the invention, as embodied and broadly described herein, the shoe includes an upper having a heel region, a rear sole secured below the heel region of the upper, and a rear sole support attached to the upper and configured to secure the rear sole below the heel region of the upper. The rear sole support includes a flexible region positioned below the heel region of the upper and above a portion of the rear sole. The flexible region is sufficiently stiff to support a user while still being sufficiently flexible to flex and spring when the user runs or walks vigorously. The flexible region has an interior portion which in its normal, unflexed state is spaced upwardly from the portion of the rear sole immediately below said interior portion, the interior portion being adapted to flex in a direction substantially perpendicular to the major longitudinal axis of the shoe as it is used.

The interior portion of the flexible region preferably is elevated relative to its peripheral portion in a direction toward the heel region of the upper. In certain embodiments the flexible region is an integral part of the rear sole support. The rear sole support may include an integral arch extension extending below the upper from a position proximate the heel region of the upper through a substantial portion of the arch region of the upper to support the arch region. The flexible region may be used with permanently attached rear soles.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION OF THE PREFERRED EMBODIMENT

Figure 1:
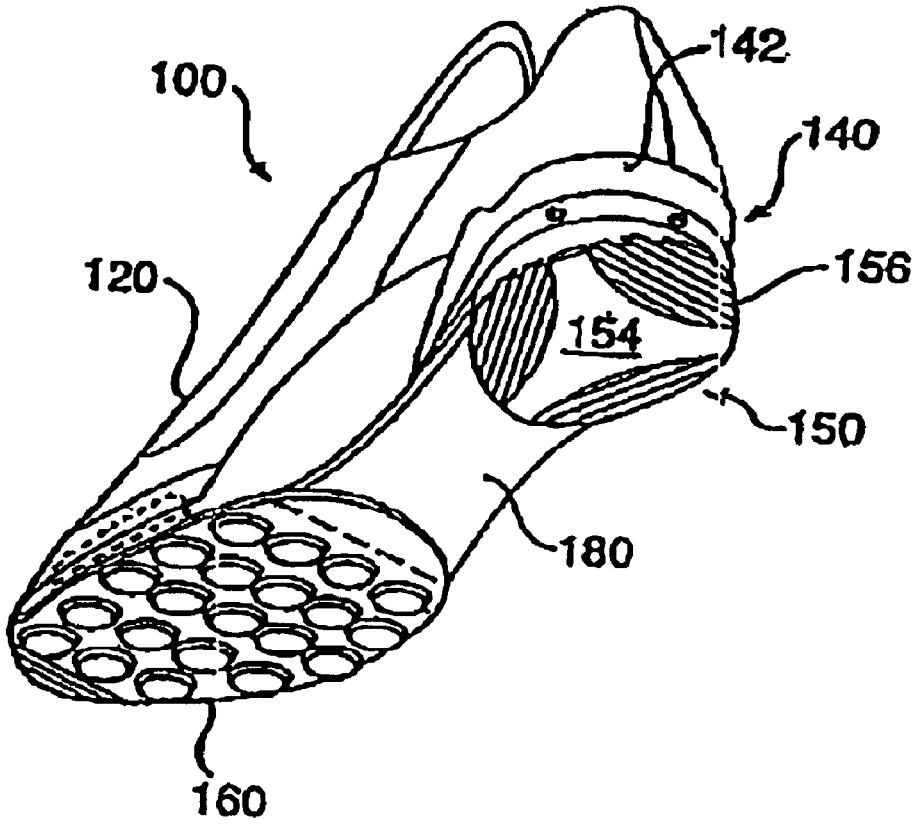
FIG. 1 is an isometric view of an embodiment of the shoe of the present invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates a first embodiment of the shoe of the present invention. The shoe, designated generally as 100, has a shoe upper 120, rear sole support 140, a rear sole 150, and a forward sole 160. Shoe 100 also preferably includes a flexible member 200 (FIG. 2) positioned between rear sole 150 and a heel region of upper 120. The flexible member provides spring to the user's gait cycle upon heel strike and reduces or eliminates interior rear midsole compression in that it is more durable than conventional midsole material.

Upper 120 may be composed of a soft, pliable material that covers the top and sides of the user's foot during use. Leather, nylon, and other synthetics are examples of the various types of materials known in the art for shoe uppers. The particular construction of the upper is not critical to the shoe of the present invention. It may even be constructed as a sandal or may be made of molded plastic, integral with the rear sole support, as in the case of ski boots or roller blade uppers.

Forward sole 180 is attached to upper 120 in a conventional manner, typically by injection molding, stitching, or gluing. Forward sole 160 typically includes two layers: an elastomeric midsole laminated to an abrasion-resistant outsole. The particular construction of the forward sole is not critical to the invention and various configurations may be used. For example, the midsole may be composed of material such as polyurethane or ethylene vinyl acetate (EVA) and may include air bladders or gel-filled tubes encased therein (shown in the area of the dotted line in FIG. 1), and the outsole may be composed of, by means of example only, an abrasion-resistant rubber compound.

Figure 2:
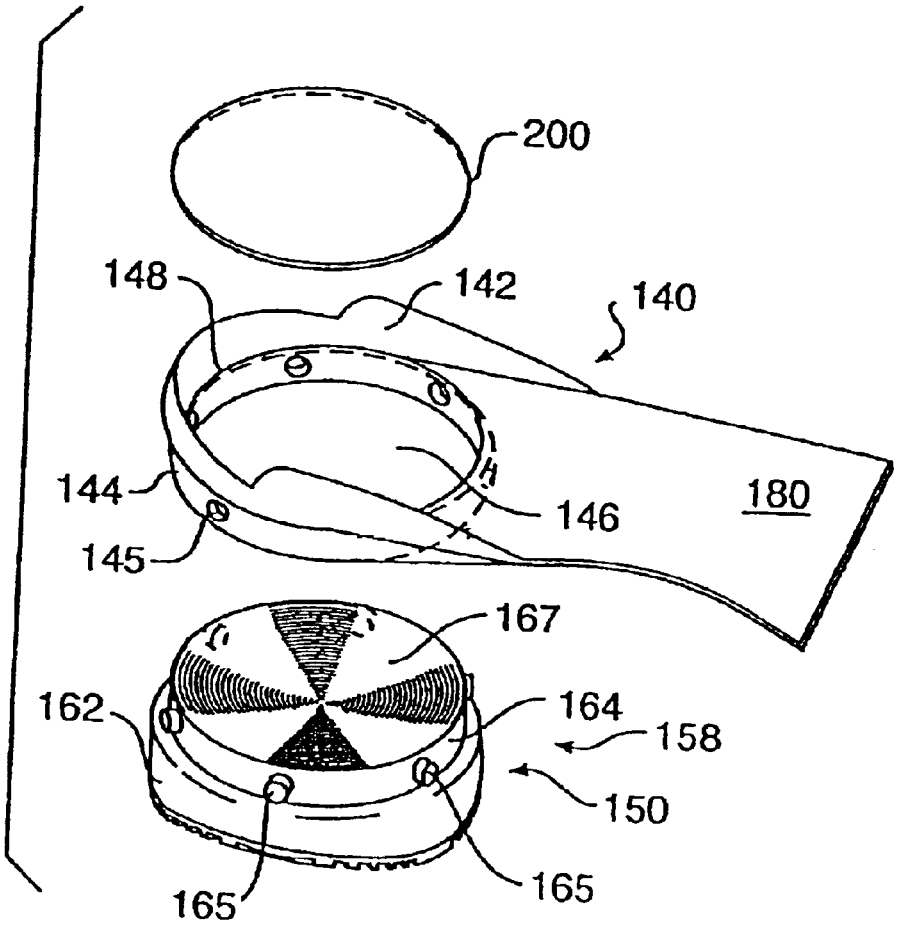
FIG. 2 is an exploded isometric view of a rear sole support, flexible member, and rear sole for the shoe of FIG. 1.

Rear sole support 140 is also attached to the heel region of upper 120 in a conventional manner, such as injection molding, stitching, or gluing. Rear sole support 140 is substantially rigid and is configured to stabilize the heel region of upper 120 and secure rear sole 150 below the heel region. As shown in FIG. 2, rear sole support 140 may include an upwardly extending wall 142, referred to as a heel counter, that surrounds the periphery of the heel region of upper 120 to provide lateral stabilization. Wall 142 preferably surrounds the rear and sides of upper 120 proximate the heel region and in service supports and stabilizes the user's heel as he or she runs. Rear sole support 140 also includes a downwardly extending side wall 144 that defines a recess 146 sized to receive a portion of rear sole 150, preferably a rear sole which is removable and rotatable to several predetermined positions. Wall 144 shown in FIG. 2 is generally circular and securely contains and holds rear sole 150. A plurality of openings 145 is formed in wall 144 to facilitate securement of rear sole 150 to rear sole support 140. The components of rear sole support 140 are preferably made integral through injection molding or other conventional techniques and are preferably composed of plastic, such as a durable plastic manufactured under the name PEBAX. It is further contemplated that the rear sole support can be made from a variety of materials, including without limitation other injection-molded thermoplastic engineering resins.

As shown in FIGS. 1 and 2, rear sole support 140 may include an arch extension or support 180 to provide a firm support for the arch of the foot and to alleviate potential gapping problems where sole support wall 144 would be adjacent forward sole 160. Arch extension 180 generally extends below upper 120 from the forward portion of side wall 144, through the arch region. It may extend as far as the ball of the foot. It is attached to upper 120 and forward sole 160 by gluing or other conventional methods. Arch extension 180 may be composed of the same material as the rear sole support and made integral with rear sole support 140 by injection molding. Alternatively, it may be made of the same or a different stiff but flexible material (such as carbon or fiberglass ribbons in a resin binder) and glued to rear sole support 140. Such one-piece construction of the arch extension together with the rear sole support solves another major problem, namely the tendency of an athletic shoe of conventional resilient material in the arch area to curl at the juncture of the substantially rigid rear sole support with the resilient forward sole.

In one embodiment of the present invention, shoe 100 also includes a rear sole 150 that is detachably secured to and/or rotatably positionable relative to rear sole support 140. Rear sole 150, as shown in FIG. 1, includes a rubber ground-engaging outsole 154 containing a planar area and three beveled segments or portions that soften heel strike during use. As shown, the beveled segments or portions formed on the outsole have the same shape and configuration and are positioned symmetrically about the periphery of the outside and preferably symmetrically positioned about the center of rear sole 150. As explained in more detail, rear sole 150 and the attachment features that permit rear sole 150 to be placed and locked into different positions relative to rear sole support 140 are designed and configured so that one symmetrically located beveled portion can be moved into the position previously occupied by another beveled portion. As a result, as one of the beveled portions begins to wear, rear sole 150 can be repositioned to place an unworn beveled portion in the area of the shoe where there is greater wear for a particular user. By periodically altering the position of the sole before any beveled portion is badly worn, (or any midsole material directly above the bevel is badly compressed) the life and effectiveness of the rear sole, and the entire shoe, can be significantly increased. Moreover, after a given rear sole wears beyond its point of usefulness, it can be replaced with a new sole with the same or different characteristics. Prior to replacement, it is also possible that left and right rear soles may be exchanged with each other inasmuch as left and right rear soles often exhibit opposite wear patterns.

As shown in FIG. 2, rear sole 150 also includes a midsole 158 laminated to outsole 154. Midsole 158 includes a substantially cylindrical lower portion 162 and a substantially cylindrical upper portion 164 that is smaller in diameter than lower portion 162. Upper portion 164 includes a plurality of resilient knobs 165 that mate with openings 145 in rear sole support 140. As shown, the resilient knobs 165 and openings 145 are symmetrically positioned about the central axis of midsole 158 and the recess of rear sole support 140, respectively. To secure rear sole 150 to rear sole support 140, rear sole 150 is simply press-fitted into recess 146 until knobs 165 engage corresponding openings 145. This manner of locking rear sole 150 into the shoe at any one of several positions is one of several mechanical ways in which the rear sole can be removed, repositioned, and/or locked to the rear sole support or other part of a shoe.

In the embodiment shown in FIG. 2, upper midsole portion 164 has a diameter at least equal to and preferably slightly larger than that of the recess into which it fits. Midsole portion 162 has a diameter substantially equal to the diameter defined by the exterior portion of circular wall 144. This configuration of elements eliminates any vertical gapping problems from occurring between the wall of the rear sole support and the peripheral surface of the rear sole.

The inside diameter of a circular recess 146, as measured between the inside surfaces of its sidewalls, or the distance between the inside surface of a medial sidewall and the inside surface of an opposite lateral sidewall in the case of a non-circular recess (not shown), may actually be greater than the width of the heel region of the shoe upper as measured from the exterior surface of the medial side of the heel region of the upper to the exterior surface of the lateral side of the heel region of the upper (i.e., the heel region of the upper at its widest point). This is possible because the material used to make the rear sole support 140 and side walls is sufficiently strong and durable to permit the side walls to "flare out" to a greater width than the heel region of the upper without risk of breakage. This in turn permits the use of a larger rear sole 150 with more ground-engaging surface and, hence, more stability. (As stated, the exterior walls of the lower portion of the rear sole generally align vertically with the exterior surface of the side walls forming the recess 146). It also permits the employment of a flexible region or member with a correspondingly larger diameter, width or length because its peripheral edges optimally should align vertically with the load-bearing side walls of the recess. Such a larger flexible region or member, with a diameter, width or length greater than the width of the heel region of the upper at its widest point, creates more cushioning and/or spring for the user's heel during the gait cycle. The observations and provisions contained in this paragraph are equally applicable to the embodiments described in FIGS. 1, 2, and 3.

Rear sole 150 is preferably made from two different materials: an abrasion-resistant rubber compound for ground-engaging outsole 154; and a softer, more elastomeric material such as polyurethane or ethylene vinyl acetate (EVA) for midsole 158. However, rear sole 150 could be comprised of a single homogenous material, or two materials (e.g., EVA enveloped by hard rubber), as well as a material comprising air encapsulating tubes, for example, disclosed in U.S. Pat. No. 5,005,300. For each of the discussed rear sole embodiments, the outsole and midsole materials are preferably more resilient than materials used for the rear sole support or arch extension.

Detachability of rear sole 150 allows the user to change rear soles entirely when either the sole is worn to a significant degree or the user desires a different sole for desired performance characteristics for specific athletic endeavors or playing surfaces. The user can rotate the rear sole to relocate a worn section to a less critical area of the sole, and eventually replace the rear sole altogether when the sole is excessively worn. By periodically changing the position of the rear sole, more uniform wear and long life (both outsole and midsole) can be achieved. Additional longevity in wear may also be achieved by interchanging removable rear soles as between the right and left shoes, which typically exhibit opposite wear patterns.

In addition, some users will prefer to change the rear soles not because of adverse wear patterns, but because of a desire for different performance characteristics or playing surfaces. For example, it is contemplated that a person using the detachable rear sole embodiment of this invention in a shoe marketed as a "cross-trainer" may desire one type of rear sole for one sport, such as basketball, and another type of rear sole for another, such as running. A basketball player might require a harder and firmer rear sole for stability where quick, lateral movement is essential, whereas a runner or jogger might tend to favor increased shock absorption features achievable from a softer, more cushioned heel. Similarly, a jogger planning a run outside on rough asphalt or cement might prefer a more resilient rear sole than the type that would be suitable to run on an already resilient indoor wooden track. Rear sole performance may also depend on the weight of the user or the amount or type of cushioning desired.

The present invention in one embodiment includes a shoe or shoe kit which includes or can accept a plurality of rear soles 150 having different characteristics and/or surface configurations, thereby providing a cross trainer shoe. As explained in more detail below, the shoe can also be designed to accept and use different flexible members in the rear sole area, to achieve optimal flex and cushioning, through the combination of a flexible member and rear sole selected to provide the most desirable flex, cushion, wear, support, and traction for a given application. In a preferred embodiment, both the rear sole and the flexible member are replaceable and a given rear sole can be locked in a plurality of separate positions relative to the recess in which it is held.

Since rear sole 150 shown in FIGS. 1 and 2 is selectively positionable relative to rear sole support 140 in a single plane about an axis perpendicular to the major longitudinal axis of the shoe, it may be moved to a plurality of positions with a means provided to allow the user to secure the rear sole at each desired position. After a period of use, outsole 154 will exhibit a wear pattern at the point in which the heel first contacts the ground, when the user is running, for example. Excessive wear normally occurs at this point, and at midsole 158 generally above this point, degrading the performance of the rear sole. When the user determines that the wear in this area is significant, the user can rotate the rear sole so that the worn portion will no longer be in the location of the user's first heel strike. For the shoe shown in FIGS. 1 and 2, rotation is accomplished by detaching the rear sole and reattaching at the desired location. For the embodiment in FIG. 3 discussed below, the rear sole may be rotated without separating it from the rear sole support. The number of positions into which rear sole of FIGS. 1 and 2 can be rotated is limited by the number of knobs/openings, but is unlimited for the rear sole shown in FIG. 3. The use of other mechanical locking systems to allow selective movement and locking of the rear sole is contemplated within the spirit of the invention.

Rotating the rear sole about an axis normal to the shoe's major axis to a position, for example, 180 degrees beyond its starting point, will locate the worn portion of the rear sole at or near the instep portion of the shoe. The instep portion is an area of less importance for tractioning, stability, cushioning and shock absorbing purposes. As long as the worn portion of the rear sole is rotated beyond the area of the initial heel strike, prolonged use of the rear sole is possible. The user can continue periodically to rotate the rear sole so that an unworn portion of the rear sole is located in the area of the first heel strike.

The shape of rear sole can be circular, polygonal, elliptical, "sand-dollar," elongated "sand-dollar," or otherwise. The shape of recess 146 is formed to be compatible with the shape of the rear sole. In all embodiments utilizing a detachable rear sole, the invention includes mechanical means for selectively locking the rear sole relative to the rear sole support and upper of the shoe. Preferably, the rear sole is shaped so that at least the rear edge of the outsole has a substantially identical profile at several, or preferably each rotated position. To allow for a plurality of rotatable positions, the shape of the outsole preferably should be symmetrical about its central axis. As shown in FIG. 1, the rear sole has three beveled portions which are symmetrically positioned about its central axis. The user in this embodiment can rotate the rear sole 120.degree. and place an unworn beveled portion at the rear heel region of the shoe, where wear is often maximum. Alternatively, the rear sole could have two beveled portions, 180.degree. apart (in an oval embodiment this would have to be the case), in which event only one rotation per shoe, plus an exchange between right and left rear soles, would be possible, before replacement of rear soles would be necessary.

While the above discussion is directed towards a rear sole that rotates or separates in its entirety, it is specifically contemplated that the same benefits of rotatable and detachable rear soles can be achieved if only a portion of the rear sole is rotatable or removable. For example, a portion of the rear sole, e.g., the center area, may remain stationary while the periphery of the ground-engaging surface or outsole rotates and/or is detachable. As another example, the rear sole may not be removable but only rotatably positionable.

In a preferred embodiment of the invention, the shoe of the present invention includes a flexible region 200 that is positioned above the rear sole and has a central portion that in its normal unflexed state is spaced upwardly from the portion of the shoe (rear sole support, or rear sole) immediately below it. The flexible region 200 is designed to provide a preselected degree of flex, cushioning, and spring, to thereby reduce or eliminate heel-center midsole compression found in conventional materials. Flexible region 200 is made of stiff, but flexible, material. Examples of materials that may be used in the manufacture of flexible member 200 include the following: graphite; fiberglass; graphite (carbon) fibers set in a resin (i.e. acrylic resin) binder; fiberglass fibers set in a resin (i.e. acrylic resin) binder; a combination of graphite (carbon) fibers and fiberglass fibers set in a resin (i.e. acrylic resin) binder; nylon; glass-filled nylon; epoxy; polypropylene; polyethylene; acrylonitrile butadiene styrene (ABS); other types of injection-molded thermoplastic engineering resins; spring steel; and stainless spring steel. The flexible region 200 can be incorporated into other elements of the shoe or can be a separate flexible member or plate.

As shown in FIG. 2, flexible member 200 can be in the form of a plate supported at its peripheral region by an upward facing top surface of rear sole support 140. In this embodiment, the member or plate 200 is positioned between the rear sole 150 and the heel portion of upper 120. A ledge 148 may be formed in rear sole support 140 to support and laterally stabilize flexible member 200.

The flexible member may also be permanently attached to the top or bottom of the rear sole support or detachably secured to the shoe upper and removable through a pocket formed in the material (not shown) typically located on the bottom surface of the upper, or it can be exposed and removed after removing the sock liner or after lifting the rear portion of the sock liner. Alternatively, it may be totally exposed as in the case of flexible member 200 shown in FIG. 18, wherein the U-shaped cushioning member may have direct contact with the user's heel without an intervening sock liner in the heel portion of the shoe. The removability of the flexible member allows the use of several different types of flexible members of varying stiffness or composition and, therefore, can be adapted according to the weight of the runner, the ability of the runner, the type of exercise involved, or the amount of cushioning and/or spring desired in the heel of the shoe.

Rear sole 150 may have a concave top surface 167, as shown in FIG. 2. Therefore, when the rear sole is attached to the rear sole support, the top surface of the rear sole does not come into contact with the flexible member when the flexible member deflects within its designed range of flex. As a result, the middle of the flexible member can flex under the weight of the user without being impeded by rear sole 150. Flexible member 200 thus acts like a trampoline to provide extra spring in the user's gait in addition to minimizing, or preventing, midsole compression in the central portion of the rear sole.

Figure 3:
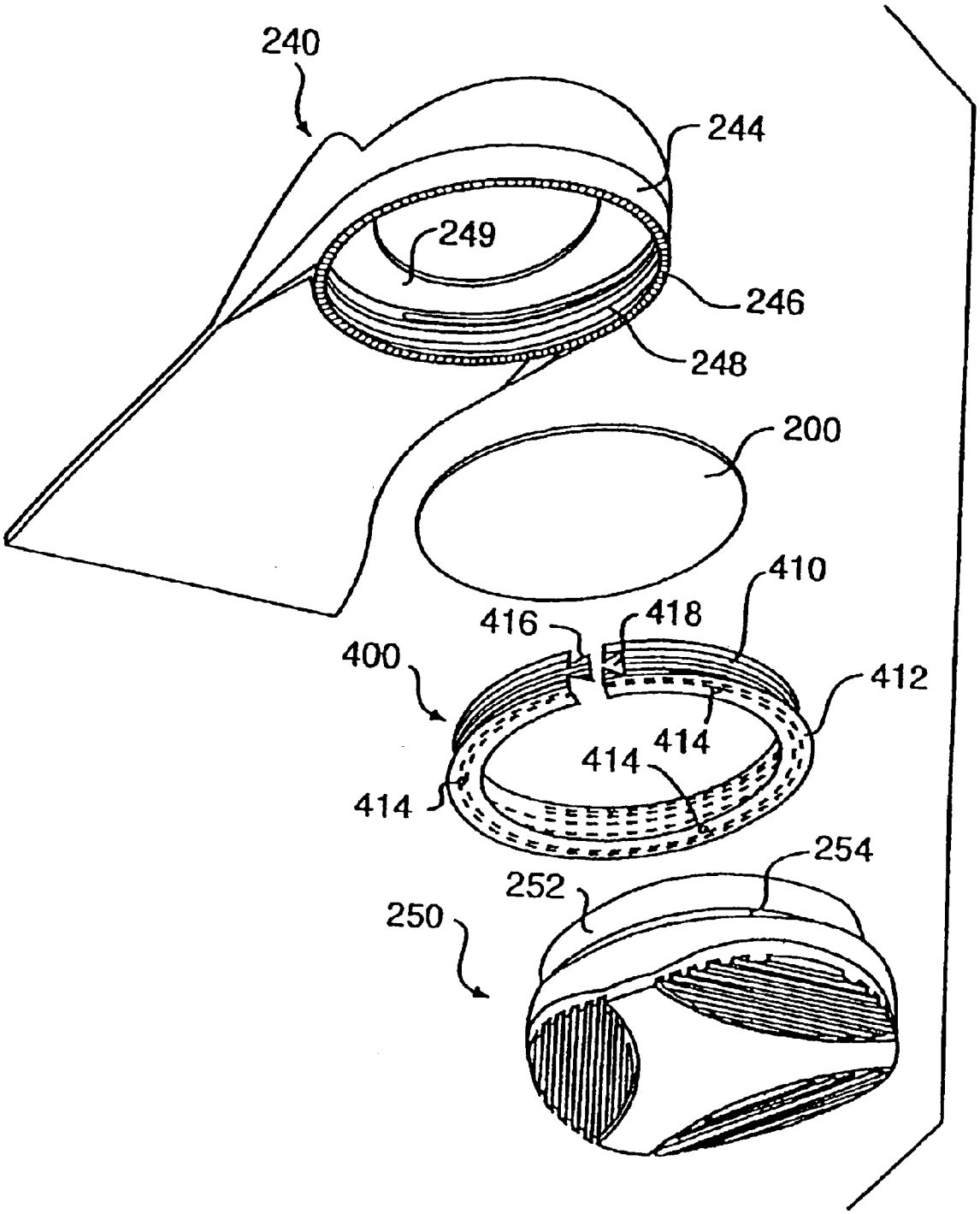
FIG. 3 is an exploded isometric view of another embodiment of a rear sole support, flexible member, and rear sole for use in the shoe of the present invention.

A second preferred embodiment is shown in FIG. 3. In this embodiment, a rear sole 250 is identical to rear sole 150 shown in FIG. 2 except that it has a groove 254 below upper midsole portion 252, instead of knobs 165. A rear sole support 240 includes a downwardly extending wall 244 that has a serrated bottom edge 246 and a threaded inner surface 248. Rear sole support 240 also includes an upper rim 249.

The embodiment of FIG. 3 also indicates a threaded ring 400. Ring 400 includes a threaded outer surface 410 that mates with threaded inner surface 248 of rear sole support 240. The ring also includes an outwardly and inwardly extending flange 412 that presses against serrated bottom edge 246 when the ring is screwed into the rear sole support. The bottom surface of flange 412 includes anchors 414, and may also be serrated to further grip the rear sole to prevent rotation. The ring also has two ends 416 and 418, and end 416 may have a male member and end 418 may be shaped to receive the male member to lock the two ends together. Ring 400 may be made of hard plastic or other substantially rigid materials that provide a secure engagement with rear sole support 240 and a firm foundation for supporting flexible member 200.

Rear sole 250 is attached to rear sole support 240 by unlocking the ends of ring 400 and positioning ring 400 around upper midsole portion 252 of the rear sole such that flange 412 engages groove 254. Ring 400 is then firmly locked onto the rear sole by mating end 416 with end 418. Flexible member 200 is inserted into the rear sole support so that it presses against upper rim 249. Ring 400, with rear sole 250 attached, is then screwed into the rear sole support by engaging threaded surface 410 of the ring with threaded surface 248 of wall 244. The ring is then screwed into the rear sole support until serrated edge 246 of wall 244 engages flange 412 of ring 400. Serrated edge 246 serves to prevent rotation of the ring during use and the top edge of ring 400 firmly supports flexible member 200.

The rear sole support sidewalls need not be continuous around the entire recess. Such sidewalls may be substantially eliminated on the lateral and medial sides of the rear sole support, or even at the rear and/or front of the rear sole support, exposing ring 400 when installed, even allowing it to protrude through the sidewalls where the openings are created. This has no effect whatsoever on the thread alignment on the inside surface of the remaining sidewalls. The advantage of doing this is that a ring with a slightly larger diameter than otherwise possible and, hence, a flexible member with a slightly larger diameter than otherwise possible may be employed.

In the embodiment shown in FIG. 3, a variety of different flexible members 200 having different flex and cushioning characteristics can be selectively incorporated into the shoe. Flexible member 200, once incorporated into the shoe, is securely held in place with rear sole support 240. Preferably, the rear sole support contacts flexible member 200 only along its outer periphery, and rear sole support 240 includes an opening above the flexible member, thereby permitting the plate to protrude upwardly toward the user's heel. Moreover, because the top surface of rear sole 250 is preferably concave in shape, the central portion of the rear sole does not contact the central portion of the flexible member in its unflexed, normal position. As a result, the flexible member can also flex downward. The degree of flexing of the member can be controlled both by the selection of the material and shape of the member, as well as the relative dimensions and shape of rear sole support 240 and rear sole 250. While flexible member 200 and the corresponding recess in rear sole support 240 are circular in FIG. 3, other shapes can be utilized. Rear sole support 240 could be designed to include a recess above upper rim 249 to accept the flexible member and a mechanical means, such as a circular locking ring, similar to ring 400, to support and lock the flexible member in place. In such an embodiment, the user could change the flexible member from the inside of the shoe. Similarly, the flexible member 200 could be fixedly secured to, or incorporated as an integral part, of either the rear sole support or the rear sole. Similar configurations of an integral flexible region are within the spirit of the invention.

The embodiment of FIG. 3 and other embodiments of the invention preferably provide a shoe that includes a flexible region or member which has its own preselected spring and cushioning characteristic and which is preferably removable and replaceable, a rear sole with its own pre-selected cushioning properties (both outsole and midsole) and which is preferably removable, replaceable, and capable of being locked in place at a plurality of preselected positions; a plurality of beveled portions on the outer surface of the rear sole which are preferably symmetrically located about its axis; and an interrelationship of the flexible member, rear sole support, and rear sole which permit the flexible member to freely flex to at least a predetermined degree. The flexible region and its characteristics, the rear sole and its characteristics, and the rear sole's relative location to the flexible region can be selectively altered, to provide in combination an optimal shoe for a given application. Also, because of the rear sole rotation and replacement permitted by the invention, typically heavy outsole material may be made thinner than on conventional athletic shoes, thus reducing the weight of the shoe. The invention also permits the weight of the shoe to be further reduced because the central portion of the midsole of the rear sole can be eliminated, since the flexible region of the shoe provides weight bearing and cushioning at this area.

Other rear sole support/rear sole combinations for securing the rear sole to the shoe and for supporting the flexible member at or below the heel region of the upper are contemplated and fall within the spirit of this invention, as described and claimed. By means of example only, some such additional configurations are disclosed in commonly-owned U.S. patent application Ser. No. 08/291,945, now U.S. Pat. No. 5,560,126, which is incorporated herein by reference.

The flexible region of the present invention is not limited to a circular shape and can be adapted to conform to the shape of the rear sole. The flexible region also need not be used only in conjunction with a detachable rear sole, but can be used with permanently attached rear soles as well.

FIGS. 4–17 show various alternative embodiments of the flexible member. In each of these embodiments, the flexible member may be curved or convex in shape, or have an inwardly curved or concave bottom surface, such that the interior portion of the flexible member is elevated relative to its periphery when the flexible member is positioned in the shoe in its normal position. Each of the following flexible member embodiments may be used in conjunction with the rear sole support/rear sole combinations disclosed in FIGS. 1–3 and more generally disclosed in this disclosure in its entirety. In addition, the following disclosed embodiments of flexible members can be integrally incorporated into a portion of the shoe. In either event, the resultant shoe has a flexible region which provides a preselected flex and spring.

Figure 4:
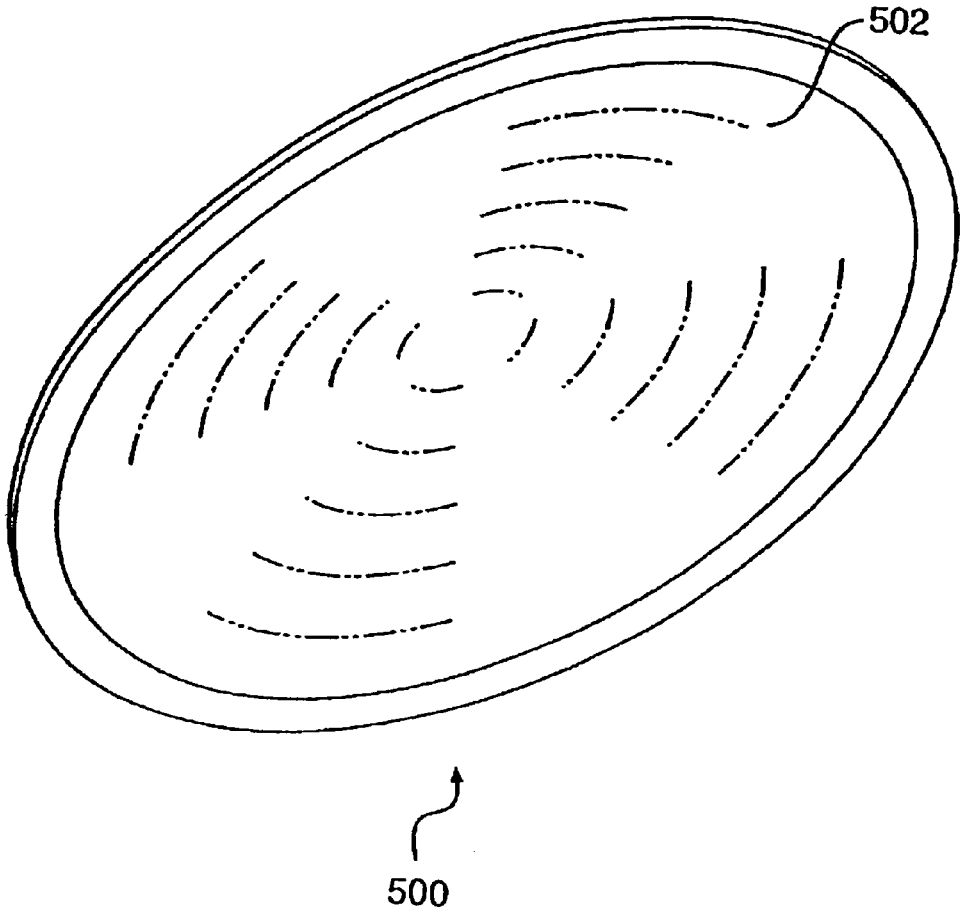
FIGS. 4–18 are isometric views of exemplary flexible member embodiments for use in the shoe of the present invention.

As shown in FIG. 4, flexible member 500 has a concave under surface 502 (when viewed from its bottom) and an opposing convex upper surface, and is circular in shape. As a result, the interior portion of the flexible member 500 is elevated relative to its peripheral portion and is positioned above a portion of the rear sole of the user when supported in the shoe.

Figure 5:
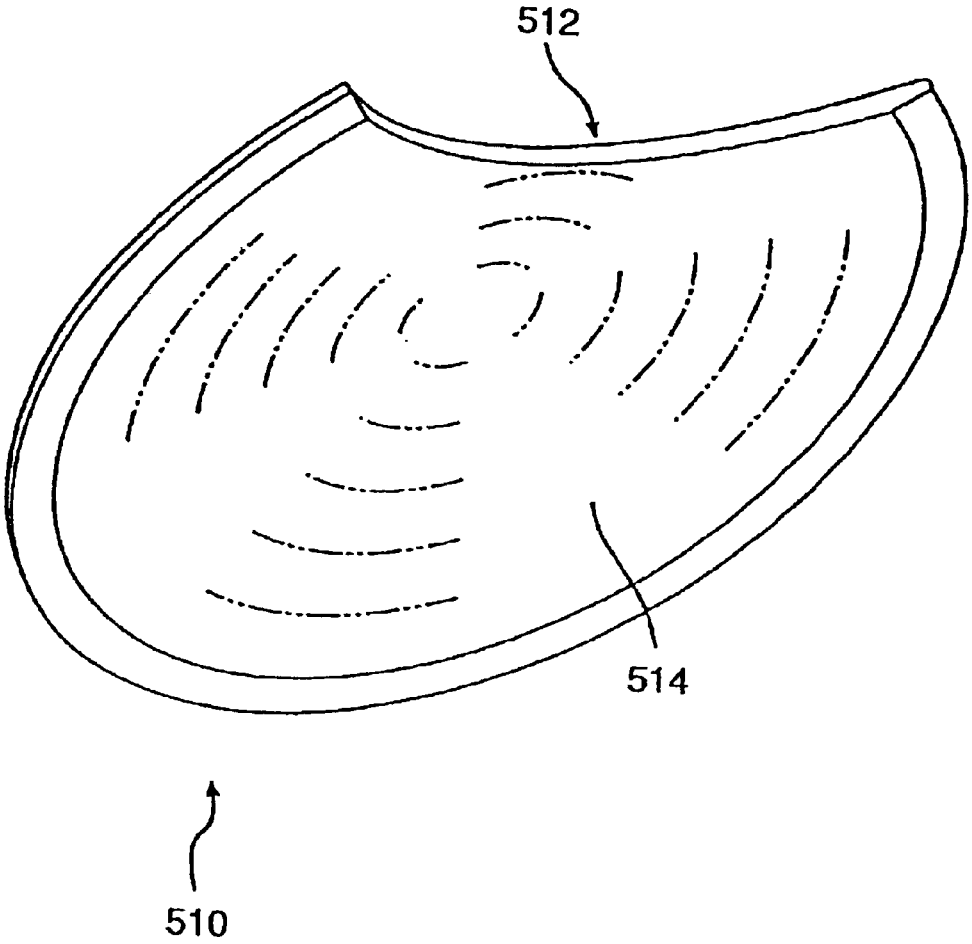
Figure 6:
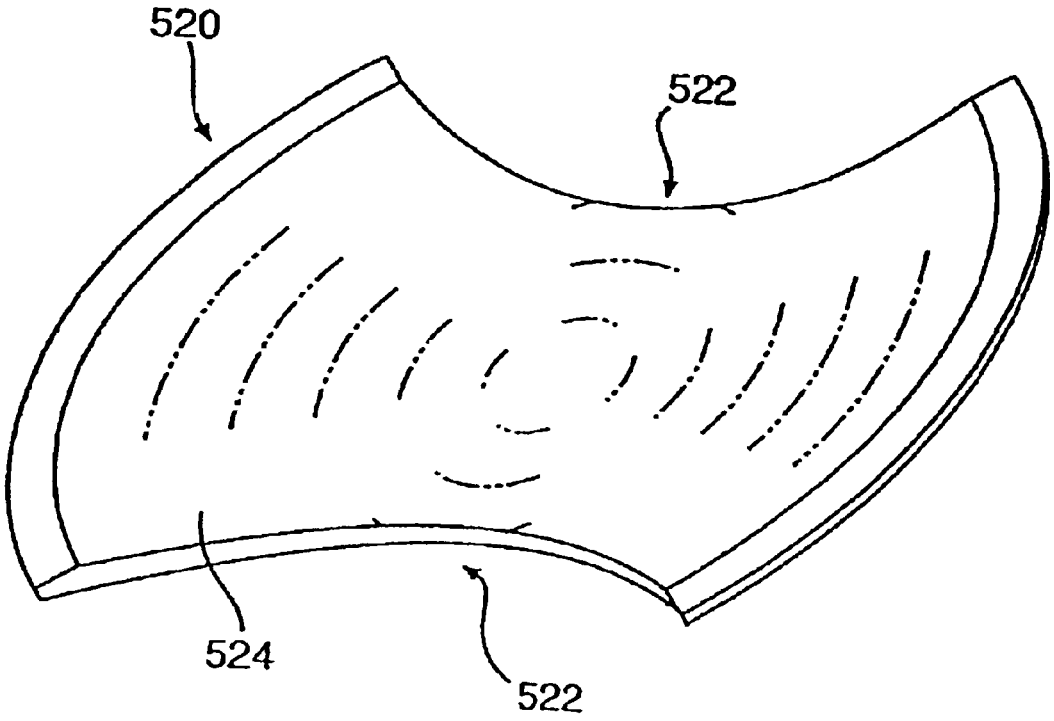
Figure 7:
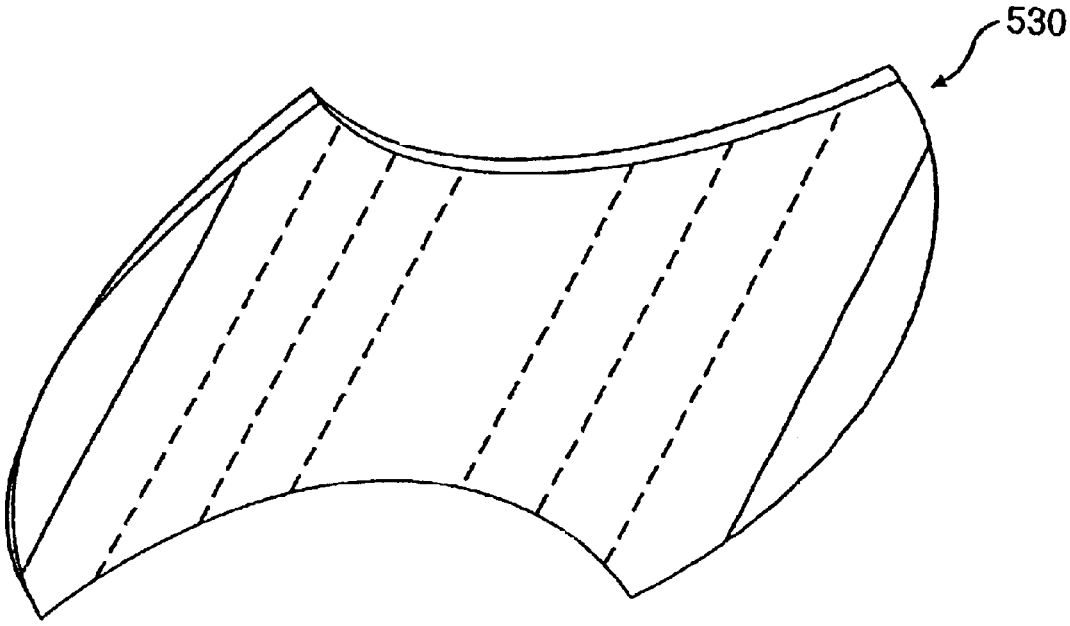

Flexible members 510 and 520 shown in FIGS. 5 and 6, respectively, are similar in structure to flexible member 500 except that flexible member 510 has a bottom surface 514 and a moon-shaped notch 512 and flexible member 520 has a bottom surface 524 and two opposing moon-shaped notches 522. Notch 512 of flexible member 510 is preferably aligned with the back of the rear sole. One of notches 522 of flexible member 520 may be aligned with the back of the rear sole, or alternatively such notches may be aligned with the lateral and medial sides of the shoe. Flexible member 530 as shown in FIG. 7 is identical in structure to flexible member 520 shown in FIG. 6 except that it is not spherically convex in shape, but rather convexly curved in only one direction. The flexible member 530 alignment options are the same as those of flexible member 520.

Figure 8:
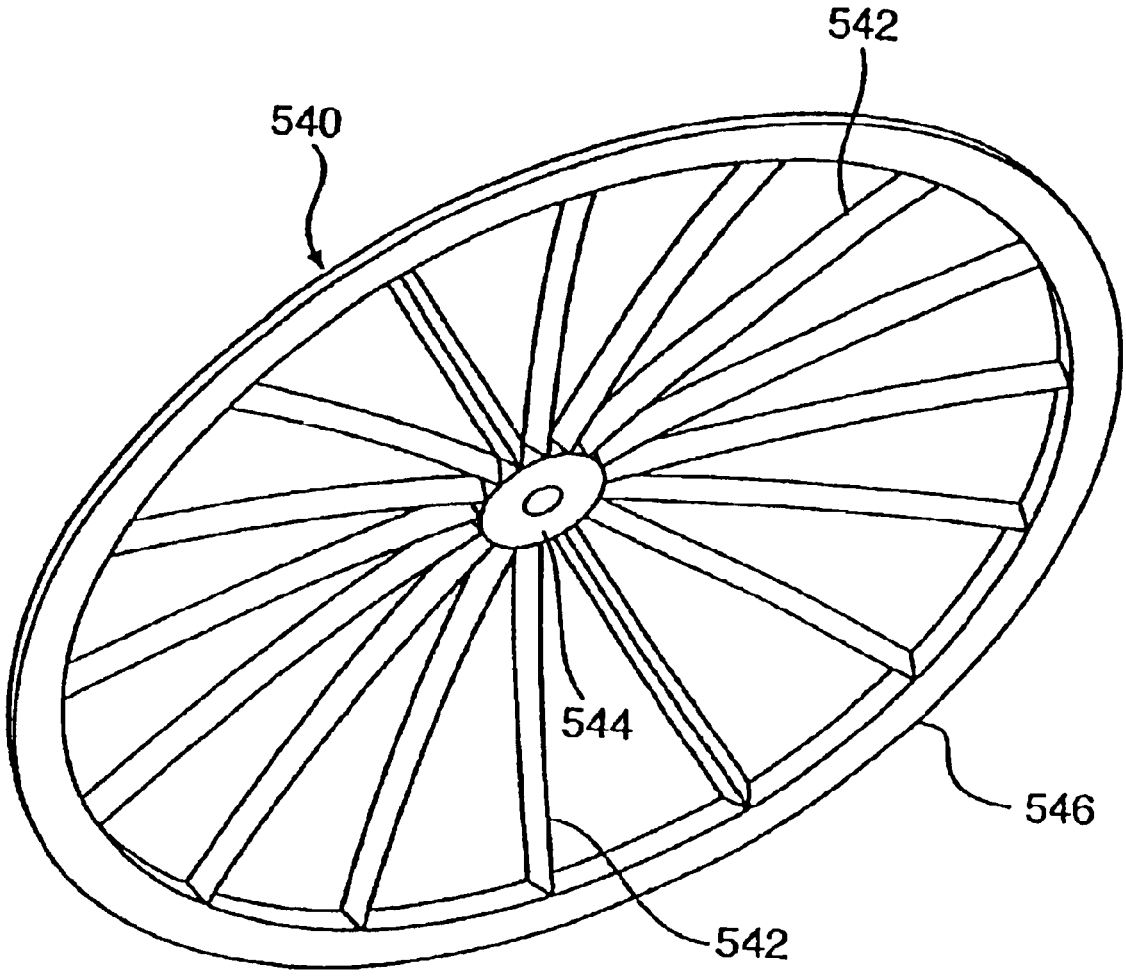

As shown in FIG. 8, flexible member 540 includes a plurality of spokes 542 each joined at one end to a hub 544 and joined at an opposite end to rim 546. The size, shape, and number of spokes is variable depending on the desired flexibility. As shown in FIG. 8, each of spokes 542 has a triangular cross-section, although the cross-section may also be square, rectangular, or any other geometrical shape. When positioned in the shoe, hub 544 is elevated relative to rim 546 such that hub 544 is closer to the heel region of the upper.

Figure 9:
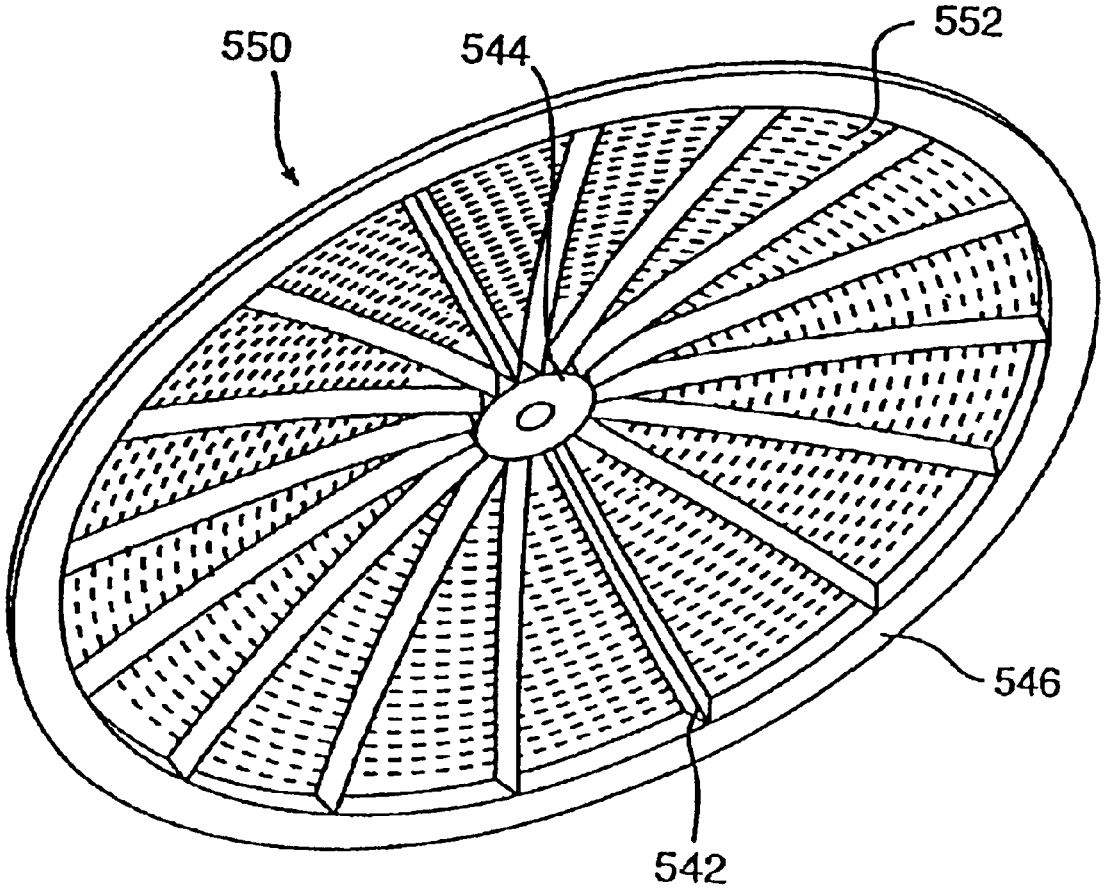
Figure 10:
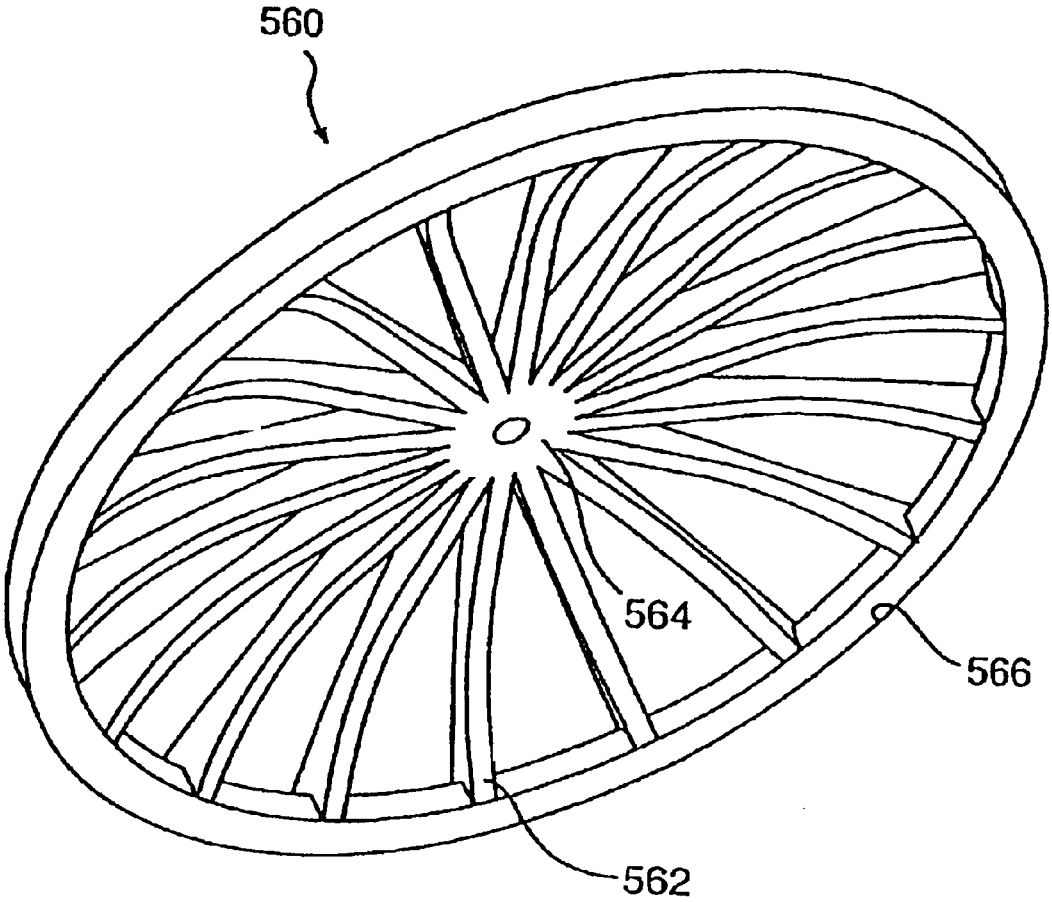

The flexible members shown in FIGS. 9–12 are variations of flexible member 540 shown in FIG. 8. Flexible member 550 shown in FIG. 9 is identical in structure to flexible member 540, but includes webbing 552 covering the top surface of flexible member 550 and joining each of spokes 542 to reinforce flexible member 550. Webbing 552 may be injection molded with the rest of flexible member. Flexible member 560 shown in FIG. 10 is similar in structure to flexible member 540 shown in FIG. 8; however, spokes 562 decrease in thickness between hub 564 and the central portion of each of the spokes 562 and then increase in thickness from the central portion toward rim 566.

Figure 11:
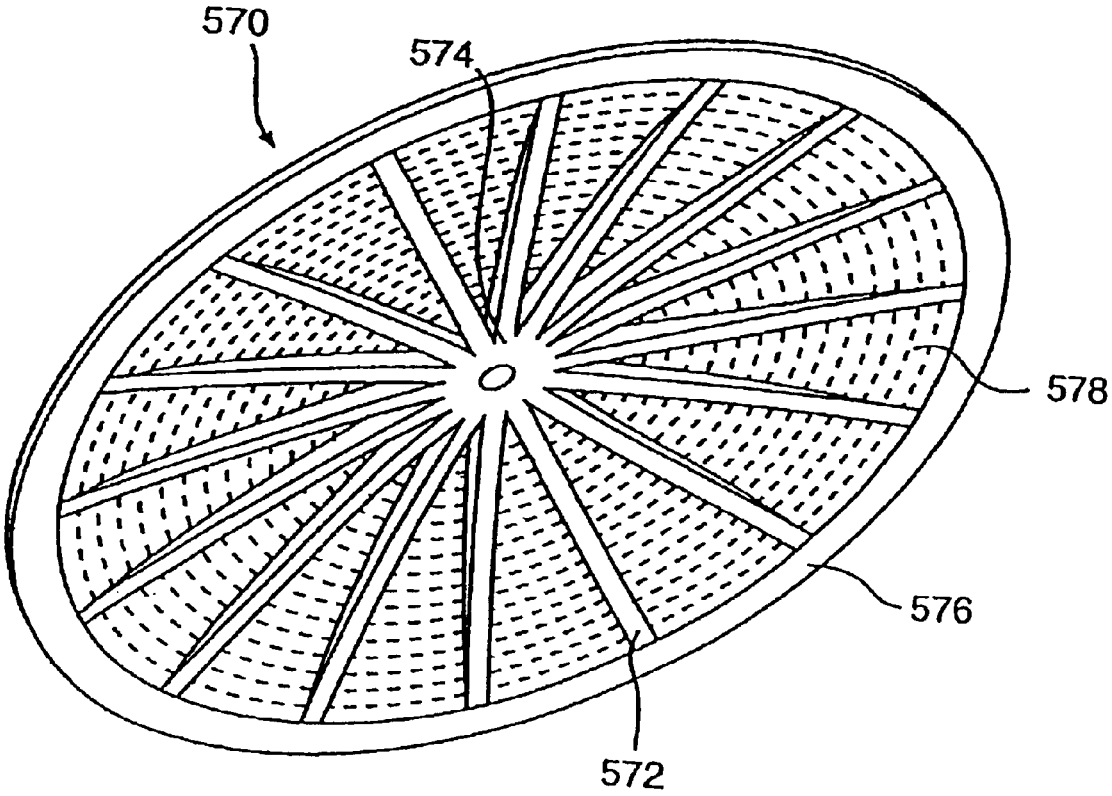

Flexible member 570, shown in FIG. 11, also includes a plurality of spokes 572 joined at opposite ends to hub 574 and rim 576. In this embodiment, the thickness of the spokes decreases in a direction from hub 574 toward rim 576. As shown in FIG. 11, the decreasing thickness of spokes 572 results in at least a portion of the interior portion of flexible member 570 in the area of the decreasing thickness spokes 572 being thinner than at least a portion of its peripheral edges or rim 576. Hub 574 and other portions of the center portion of the interior portion of flexible member 570 are shown as being thicker than another portion of the interior portion of flexible member 570, such as in the area of decreased spoke thickness. As shown in FIG. 11, center portion or hub 574 and peripheral edge or rim 576 may both be thicker than a portion of the interior portion of flexible member 570 between hub 574 and rim 576. In addition, webbing 578 may be placed over the top surface of flexible member 570 similar to that disclosed in FIG. 9. As shown in FIG. 11, spokes 572 are preferably oriented such that each spoke is oriented 180 degrees from an opposite spoke to provide a rib that extends substantially across flexible member 570. Whether referred to as opposite spokes 572 or a rib the thickness may be varied. The rib is preferable integrally formed with flexible member 570 and more preferably is on the bottom surface or concave surface of flexible member 570. As can be seen in FIG. 11, a hole may be provided through flexible member 570 and more particularly, through the center or hub 574. As can be further determined from FIG. 11, flexible member 570 may be substantially planar in shape, but is not conical in shape.

Figure 12:
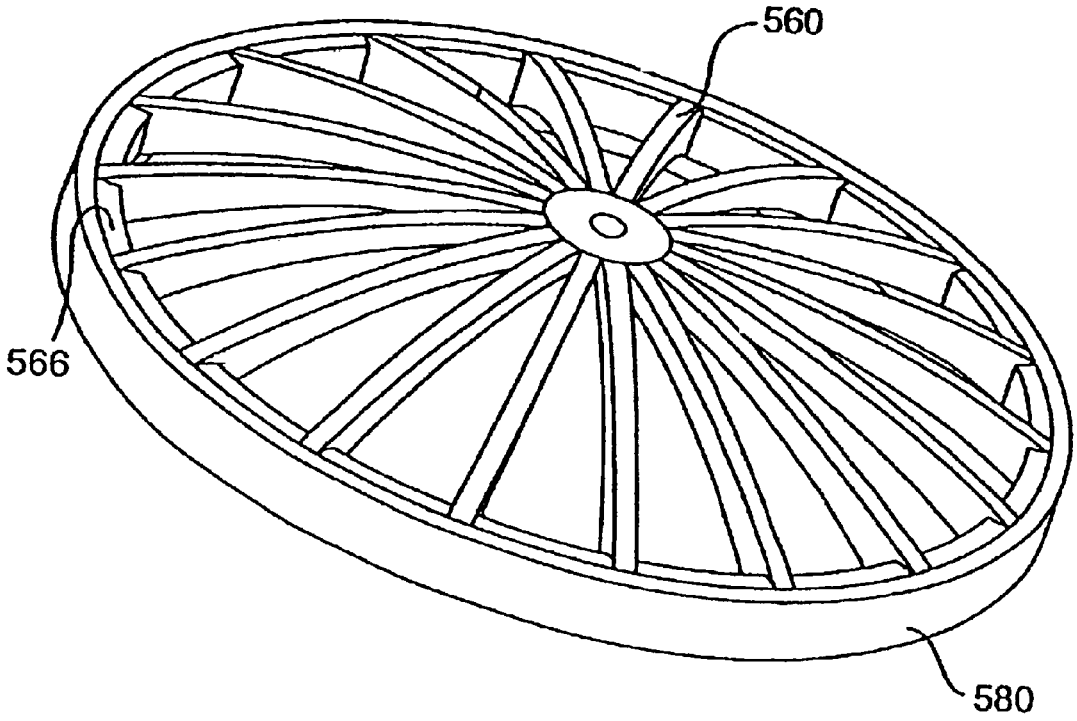

FIG. 12 illustrates a housing 580 for supporting the flexible member, in this example, flexible member 560. Housing 580 has an L-shaped cross-section to support the bottom and side surfaces of rim 566. Housing 580 may be inserted into the shoe heel with flexible member 560 or may be permanently affixed to the rear sole support. In either case, housing 580 acts as a reinforcement for limiting or eliminating lateral movement of flexible member 560 during use. This may have the effect of making the center of the flexible member more springy. It may also allow the member to be made of thinner and/or lighter weight material.

Figure 13:
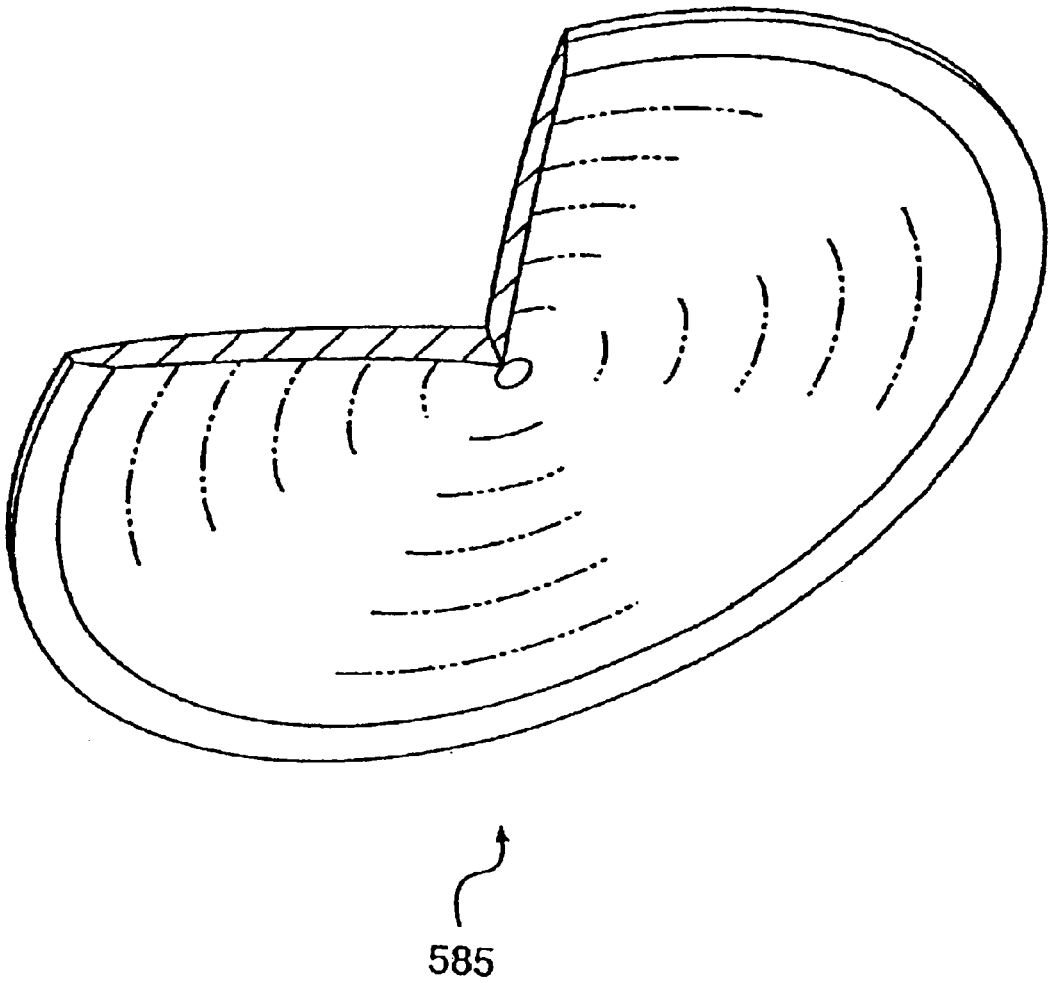
Figure 14:
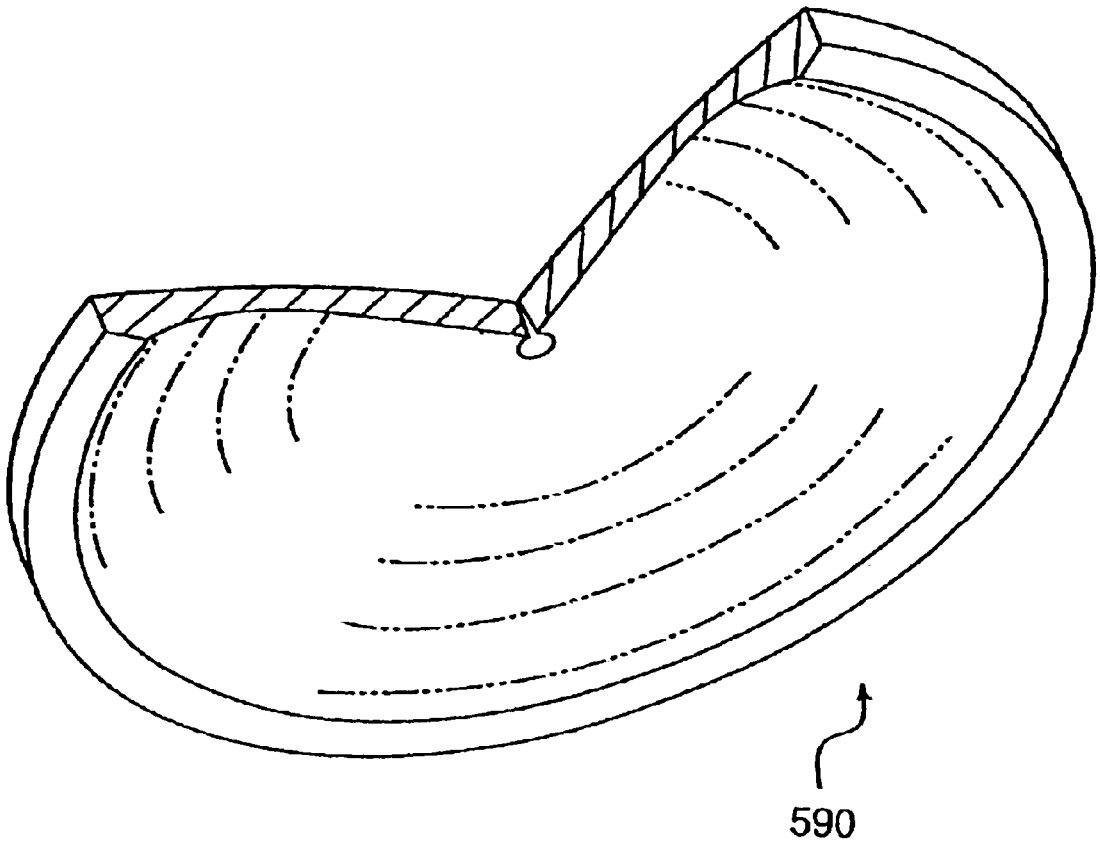
Figure 15:
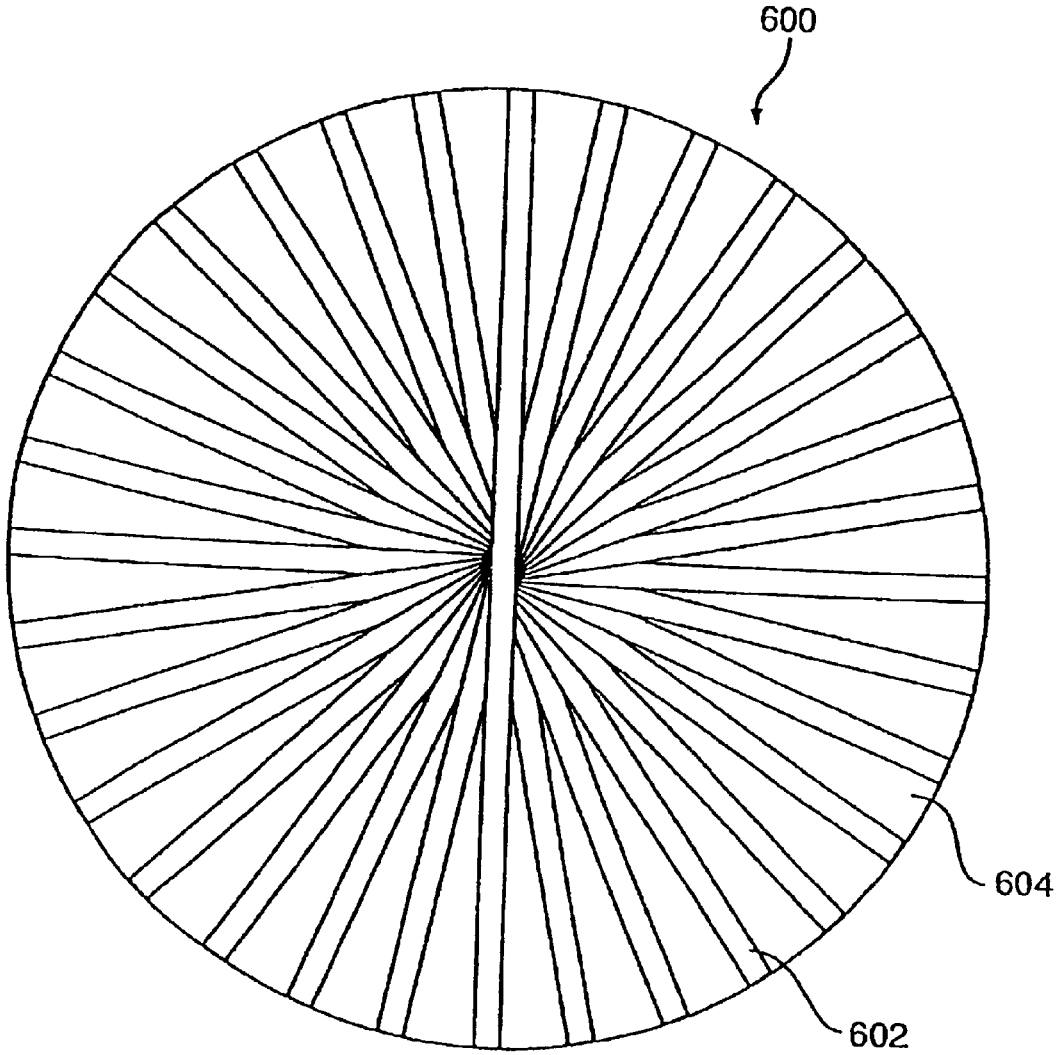
Figure 16:
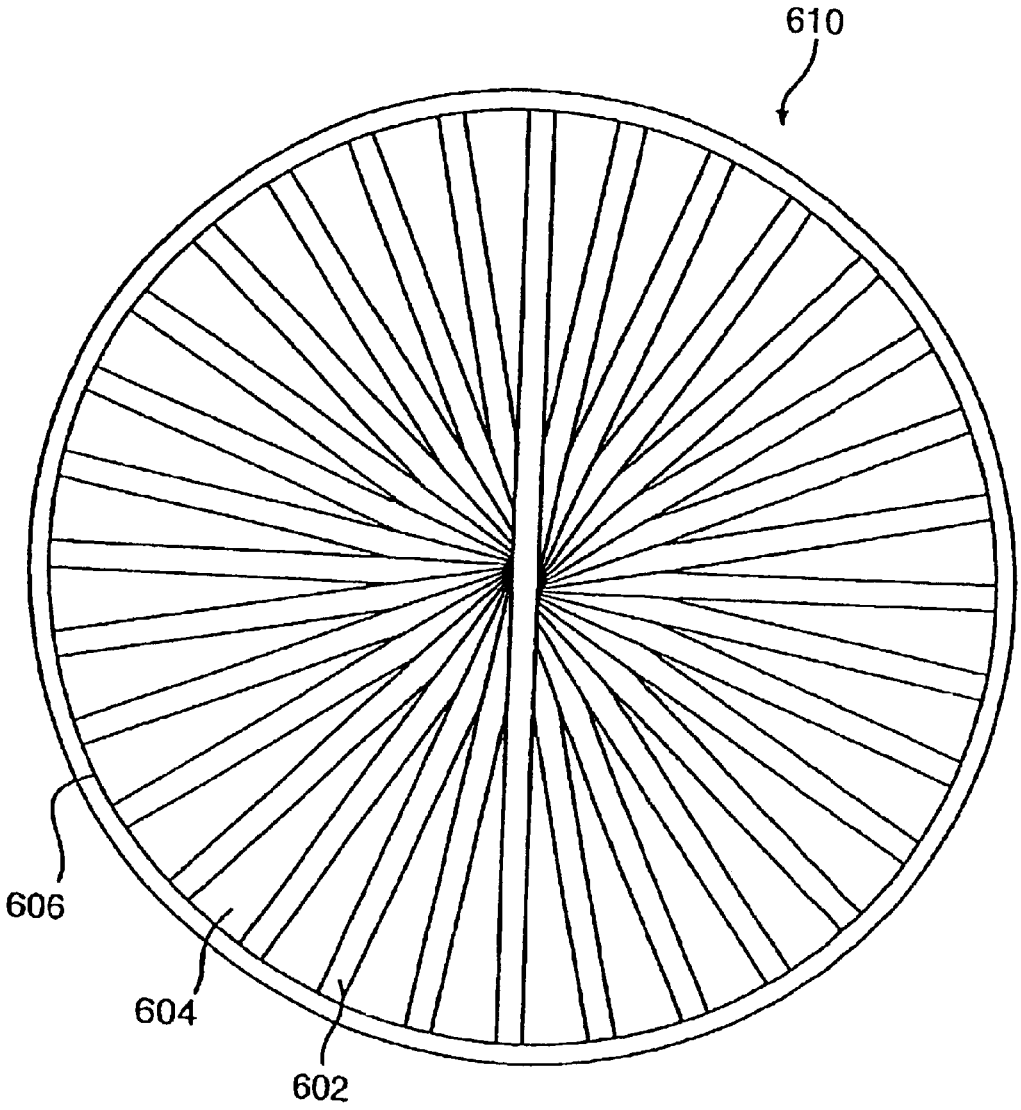

FIGS. 13 and 14 show further variations of flexible plate 500 shown in FIG. 4. While flexible plate 500 has a generally uniform thickness at any given radius, flexible plate 585 shown in FIG. 13 decreases in thickness from the center of the member toward its periphery. Flexible member 590 shown in FIG. 14, on the other hand, is thicker near the center and at the periphery, but thinner therebetween.

Figure 17:
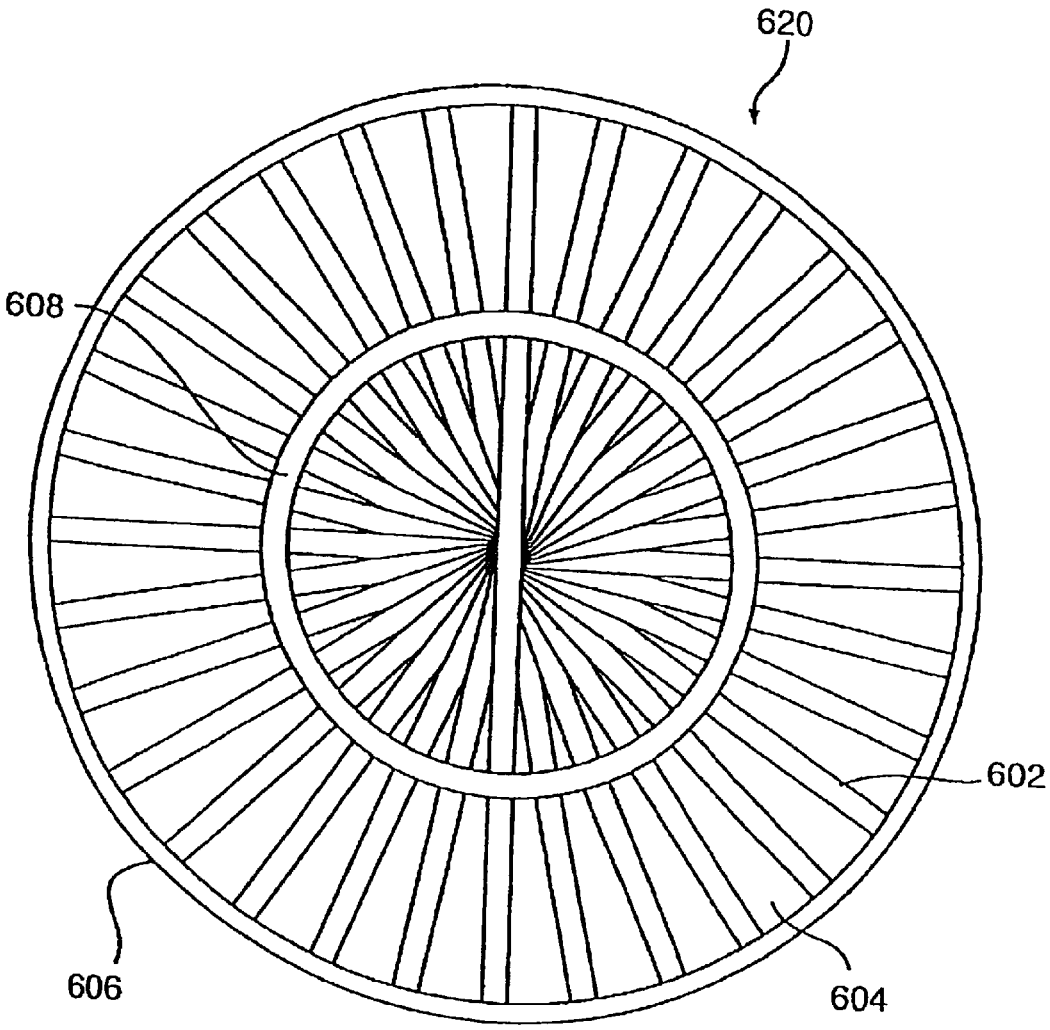
Figure 17A:
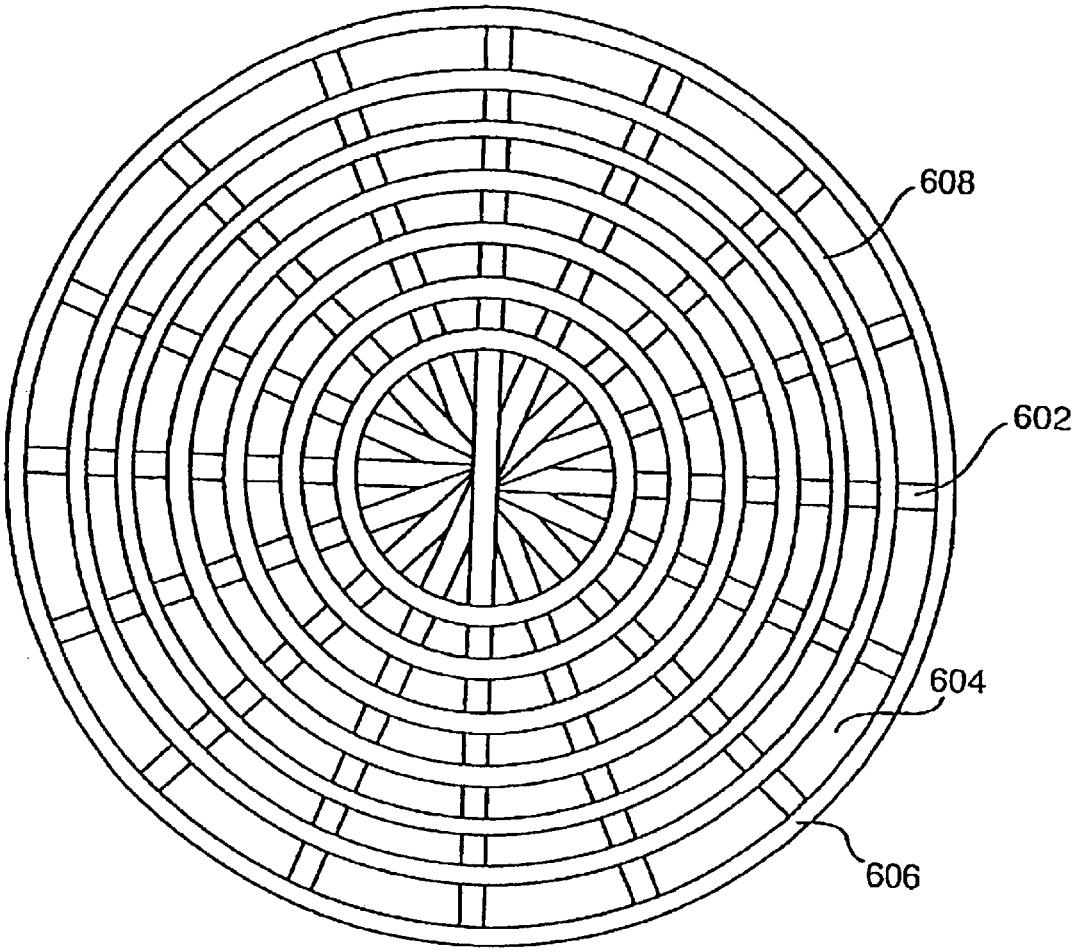

FIGS. 15–17A disclose flexible members composed of carbon ribbons set in a resin binder. Alternatively, they may be fiberglass ribbons or a combination of carbon and fiberglass ribbons. Ribbons made of other types of fiber may also be used. Flexible member 600 includes radially or diametrically projecting ribbons 602, either emanating from the center of flexible member toward its periphery or, preferably, passing through the center from a point on the periphery to a diametrically opposite point on the periphery. These ribbons 602 are fixed in position by a resin binder 604 known in the art. Flexible member 610 shown in FIG. 16 also includes carbon ribbons 602 set in a resin binder 604, but further includes a rim 606 comprised of ribbon preset in the resin binder and defining the periphery of flexible member 610. Flexible member 620 shown in FIG. 17 is identical to flexible member 610 shown in FIG. 16 except that it further includes a circular ribbon 608 disposed in resin binder 604 and circumscribing the center of flexible member 620. The flexible member shown in FIG. 17A is identical to the flexible member 610 shown in FIG. 17 except that it has fewer spokes and further includes a plurality of circular ribbons 608 spaced radially from the center of the member and disposed in the resin binder 604. Flexible members 600, 610, and 620 may be convex in shape so that the center of the flexible member is raised relative to its outer perimeter, when placed in the shoe. They may also have a U-shaped cushioning member placed on or secured to their top surface like that shown in FIG. 18.

Figure 18:
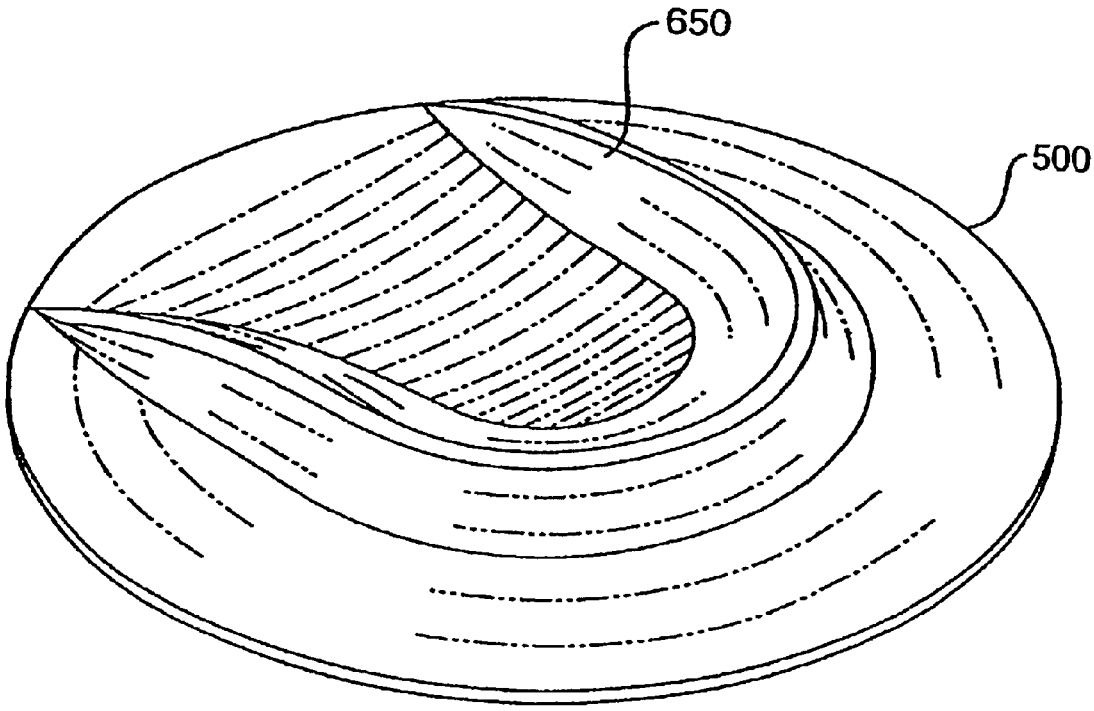

Since it is contemplated that the flexible member will be composed of graphite or other stiff, but flexible, material, it is preferable to cushion the impact of the user's heel against the flexible member during use. As shown in FIG. 18, a substantially U-shaped cushioning member 650 is disposed on the top surface of flexible member 500 to cushion the heel upon impact. The U-shaped cushioning member is shaped to generally conform to the shape of the user's heel. Thus, the open end of the U-shape is oriented toward the front of the shoe. Cushioning member 650 may be composed of polyurethane or EVA or may be an air-filled or gel-filled member. Cushioning member 650 can be affixed to flexible member 500 by gluing, or may be made integral with flexible member 500 in an injection molding process. If injection molded, cushioning member 650 would be made of the same material as flexible member 500. To decrease the stiffness of cushioning member 650 in this instance, small holes (not shown) may be drilled in cushioning member 650 to weaken it and thereby allow it to depress more readily upon impact and more uniformly with flexible member 500.

The cushioning member 650 described above can be incorporated into a shoe having any of the various flexible regions disclosed in this application and drawings, as well as other shoes falling within the scope of the claims.

If cushioning member 650 is used, the shoe sock liner, which generally provides cushioning, may be thinner in the heel area or may terminate at the forward edge of cushioning member 650. If cushioning member 650 is not used, the sock liner may extend to the rear of the shoe and may be shaped to conform to the user's heel on its top surface and the flexible member on its bottom surface. Its bottom surface may also compensate for gaps formed by the flexible member. For example, the sock liner may have a concave bottom surface in the heel area to correspond to those flexible members having convex upper surfaces.

In each of the above-described embodiments, the flexible member is illustrated as a separate component of the shoe which can be removed from the shoe and replaced by a similar or different flexible member, as desired. In each of the embodiments the central portion of the flexible member is raised relative to its outer perimeter so that when placed in the shoe, the interior portion in its normal state does not touch the rear sole support and/or rear sole. As a result, the interior of the flexible member will flex in response to the user's stride without first, if ever, contacting the rear sole support and/or rear sole. Such flexible member, therefore, can be used with rear soles that have a flat upper surface, as well as those that have a concave upper surface. The relative shape and positioning of the flexible member and the adjacent rear sole support or rear sole can be designed to provide the optimum flex, stiffness, and spring characteristics. However, each of the above-described flexible members may be made integral with the rear sole support, which not only decreases the number of loose parts and increases the efficiency of the manufacturing process, but also further limits the lateral displacement of the periphery of the flexible member upon deflection, potentially creating more spring in the center and/or permitting the use of thinner and/or lighter weight material.

Figure 19:
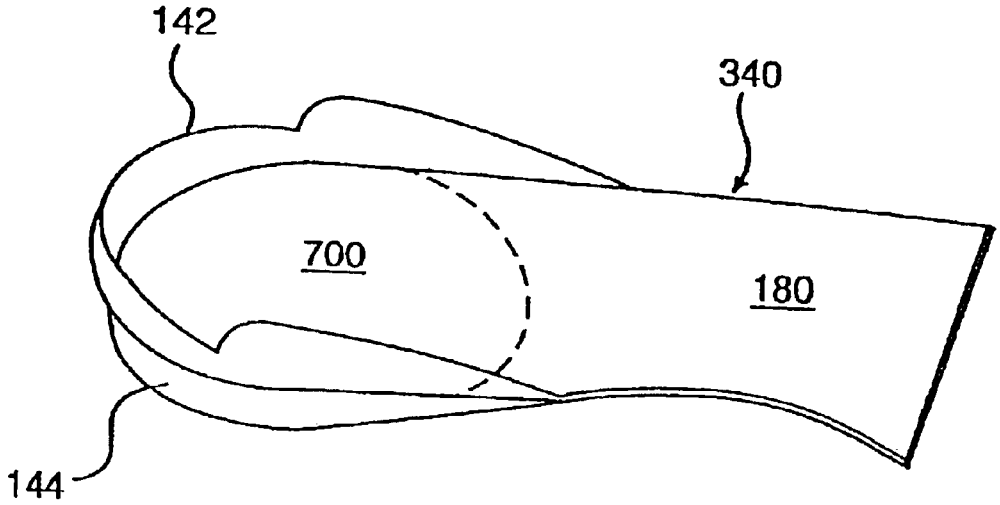
FIG. 19 is an isometric view of another embodiment of a rear sole support for use in the shoe of the present invention.

As shown in FIG. 19, rear sole support 340 is identical in structure to rear sole support 140 shown in FIG. 2 except that rear sole support 340 has a flexible region 700 that serves the same purpose and function as any of the above-described flexible members. In fact, any of the above-described flexible members may be used as flexible region 700 so long as they can be made integral with rear sole support 340. In this example, flexible region 700 is convex in shape and thus similar to flexible member 500 shown in FIG. 4. Cushioning member 650 or a modified sock liner as described above may also be used.

The flexible region may be incorporated into other rear sole support embodiments as well. As an alternative to using arch extension 180, rear sole support 440 shown in FIGS. 20–22 includes a thickened tongue 447 that extends toward the ball of the foot. Thickened tongue 447 provides additional gluing surface for attaching the rear sole support to forward sole 160 and additional stiffness to the heel portion of the shoe and the arch area, thus minimizing the chances of separation of the forward sole from the rear sole support, and at the same time minimizing the tendency of the shoe to curl at the juncture of the hard rear sole support with the soft forward sole. Similar to rear sole support 240, rear sole support 440 includes a heel counter 442 and a side wall 444. Rear sole support 440 also includes a rim 448 and anchors 452 to receive and retain a rear sole with a mating groove, such as rear sole 250. Forward sole 260 is longer in this embodiment to extend back to the edge where it would abut the rear sole. Flexible region 710 is identical to flexible region 700 in FIG. 19.

Figure 20:
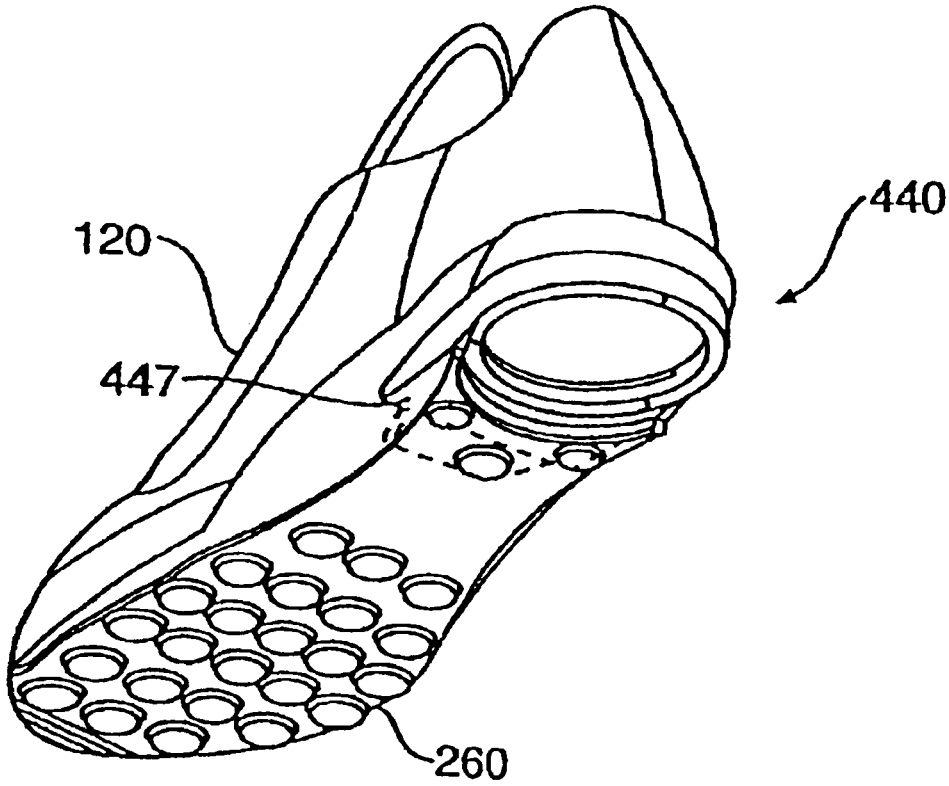
FIG. 20 is an isometric view of another embodiment of the shoe of the present invention.
Figure 21:
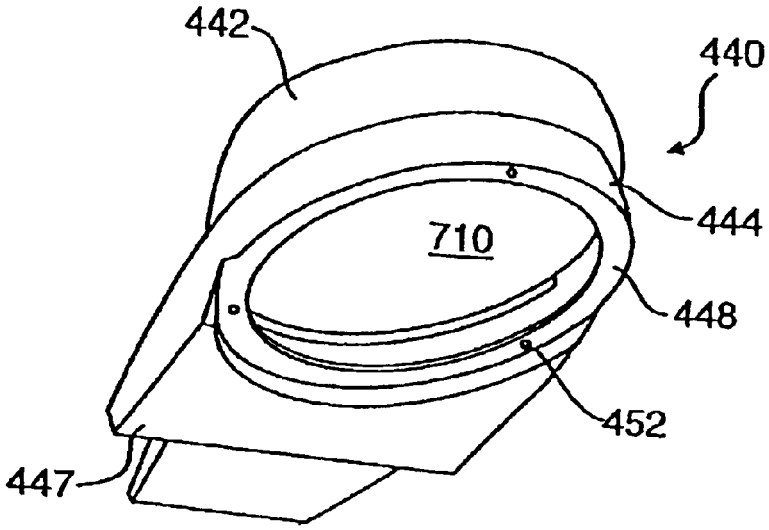
FIGS. 21 and 22 are isometric views of a rear sole support for the shoe of FIG. 20.
Figure 22:
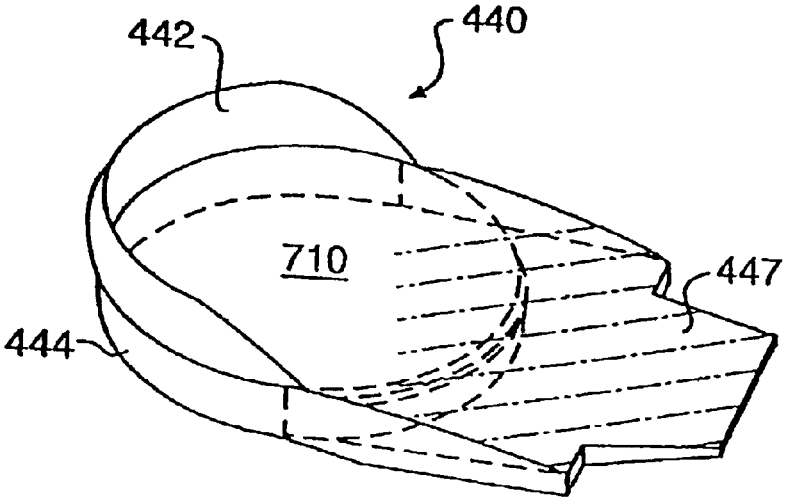
Figure 23:
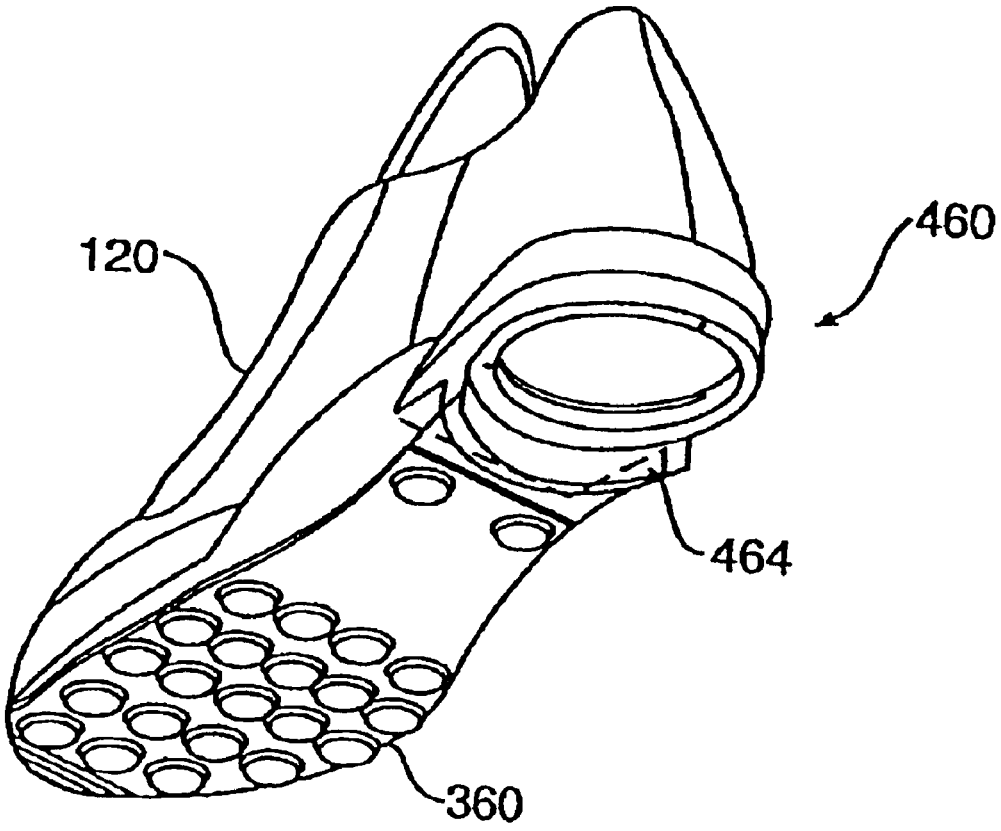
FIG. 23 is an isometric view of another embodiment of the shoe of the present invention.
Figure 24:
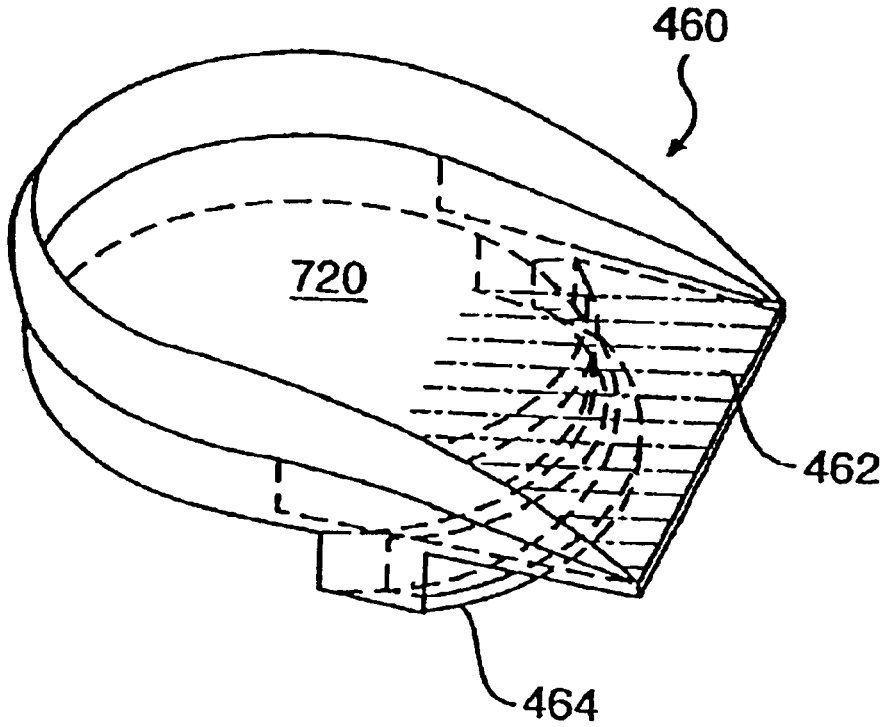
FIG. 24 is an isometric view of a rear sole support for the shoe of FIG. 23.

In another embodiment, rear sole support 460, as shown in FIGS. 23 and 24, includes a tongue 462 that is thinner and slightly smaller than tongue 447 shown in FIGS. 20–22. However, rear sole support 460 includes a curved wall 464 that has a pocket formed on its forward side for receiving a mating rear edge of forward sole 360 adjacent the rear sole support. Curved wall 464 provides a firm, smoothly contoured transition from hard-to-align resilient materials of the forward and rear soles and thereby minimizes gapping. It also provides a desirable brace or bumper for the lower portion of the rear sole when the user is running. Flexible region 720 is identical to flexible regions 700 and 710.

Figure 25:
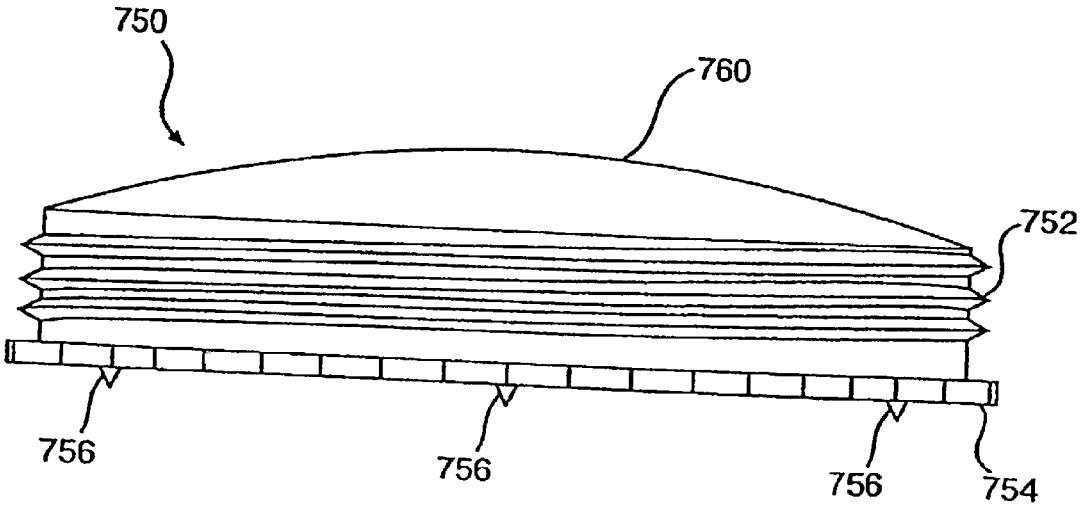
FIG. 25 is a side elevation view of a securing member for use in the shoe of the present invention.
Figure 26:
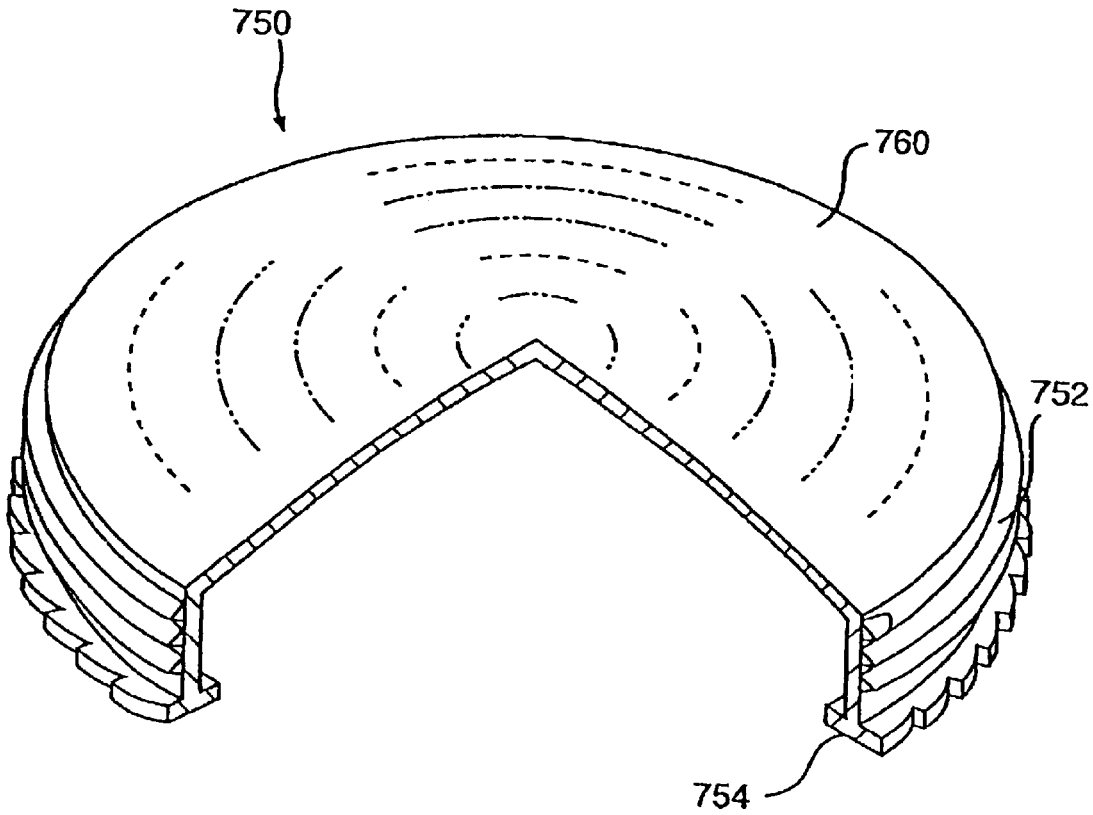
FIG. 26 is a partial cut-away isometric view of the securing member of FIG. 25.

As shown in FIGS. 25 and 26, the flexible member may also be integrated with the securing member. Securing member 750 is similar in structure and function as securing member 400 in that it includes a wall 752 with a threaded outer surface, an inwardly and outwardly extending rim 754, and anchors 756. Securing member 750 also includes a convex flexible region 760 integral with wall 752. Flexible region 760, like flexible regions 700 and 710, may incorporate any of the configurations shown in FIGS. 4–18.

Securing member 750 is simply substituted for securing member 400 and flexible member 200 shown in FIG. 3 to attach rear sole 250 to rear sole support 240. However, since securing member 750 does not include mating ends 416, 418, rear sole 250 is press-fitted into securing member 70 until rear sole groove 254 mates with securing member rim 754. This may have the effect of making the center of the flexible member more springy. It may also allow the flexible member to be made of thinner and/or lighter weight material.

Figure 27:
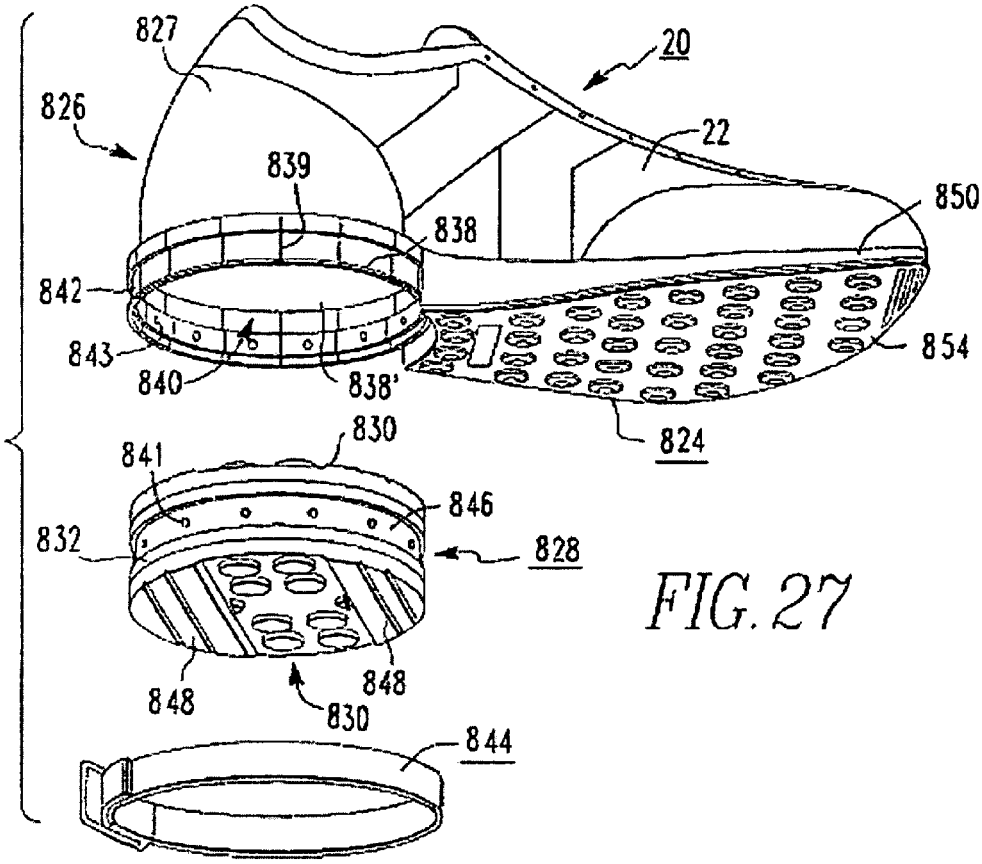
FIG. 27 is an exploded isometric view of an embodiment of the shoe of the present invention.

FIG. 27 illustrates another embodiment of the shoe of the present invention. The shoe, designated generally as 820, has a shoe upper 822, a forward sole 824, a heel support 826, and a rear sole 828. The forward sole and heel support are attached to the shoe upper in a conventional manner, typically by injection molding, stitching or gluing.

As shown in FIG. 27, the heel support 826 preferably includes a heel counter 827 for stabilizing a heel portion of the upper 22 above the heel support and a side wall 838 that extends downwardly from the upper and defines a recess 840 sized to receive the rear sole. The heel support may also include a substantially horizontal top wall 838' for supporting the heel portion of the upper. Otherwise, the top of the rear sole or an insert, as will be discussed in more detail later, will support the heel portion of the upper. The components of the heel support, including heel counter 827 and the side wall 838, are preferably made integral through injection molding or other conventional techniques and are preferably composed of plastic, such as a durable plastic manufactured under the name PEBAX.

The shape of the rear sole 828 can be circular, polygonal, elliptical, "sand-dollar," elongated "sand-dollar" or otherwise. Preferably, the rear sole is shaped so that the rear edge of the ground-engaging surface 830 has a substantially identical profile at each rotated position. To allow for a plurality of rotatable positions, the shape of the ground-engaging surface 830 preferably should be symmetrical about at least one axis. The ground-engaging surface 830 can be planar or non-planar. Preferably, the ground-engaging surface, particularly on running shoe models, includes one or more tapered or beveled edges 848, as shown in FIG. 27, to soften heel strike during use.

Further embodiments are disclosed that show the various ways of attaching the rear sole to the heel support in accordance with the invention. The general features of the embodiment of FIG. 27, such as the shape of the rear sole and the material composition of the shoe elements, will apply to any of the embodiments of FIGS. 28–41 unless otherwise noted.

Figure 29:
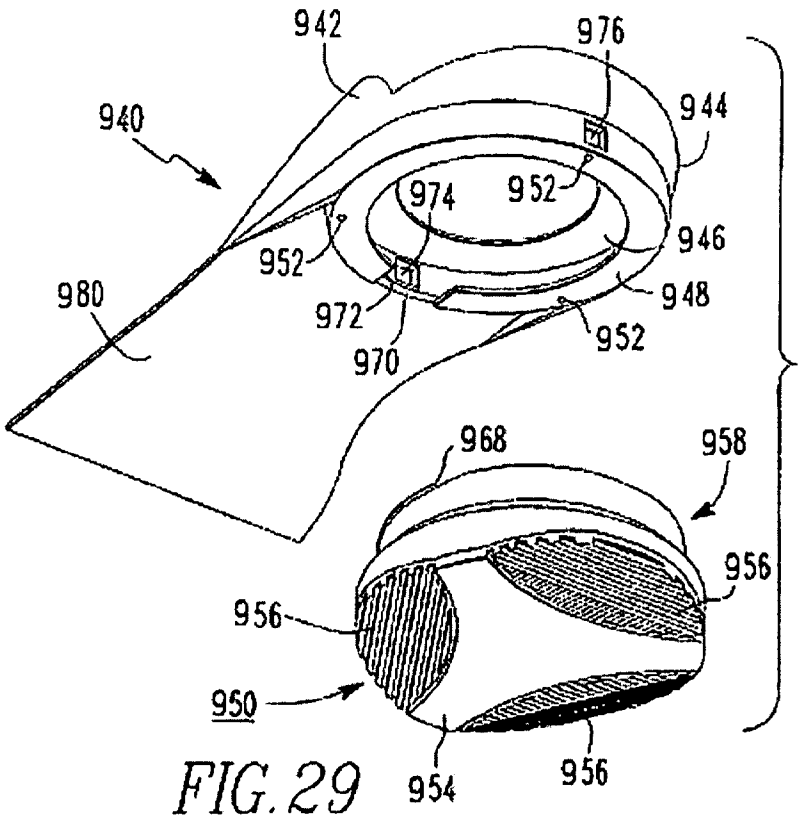
FIG. 29 is an exploded isometric view of a heel support and rear sole for the shoe of FIG. 28.

Another embodiment of the present invention is shown in FIGS. 28–31. The shoe includes an upper 22, a heel support 940, a rear sole 950, and a forward sole 960. As shown in FIG. 29, the heel support 940 includes a heel counter 942, a downwardly extending wall 944 that defines a recess 946 sized to receive the rear sole, and a rim 948 formed around the lower portion of the wall and extending inwardly into the recess. Anchors 952 may be formed on the bottom surface of the rim 948 and extend downwardly toward the rear sole 950.

Figure 31:
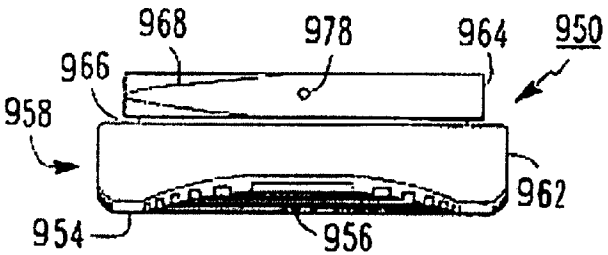
FIG. 31 is a side elevation view of the rear sole of FIG. 30.

The rear sole 950 includes a rubber ground-engaging surface 954 containing, in this embodiment, three beveled segments or edges 956. As shown in FIG. 31, the rear sole 950 also includes a midsole 958 laminated to the ground-engaging surface 954 that includes a substantially cylindrical lower portion 962 and a substantially cylindrical upper portion 964 that is smaller in diameter than the lower portion. A groove 966 is formed between these upper and lower portions and receives the rim 948 of the heel support to retain the rear sole in the heel support recess.

Figure 30:
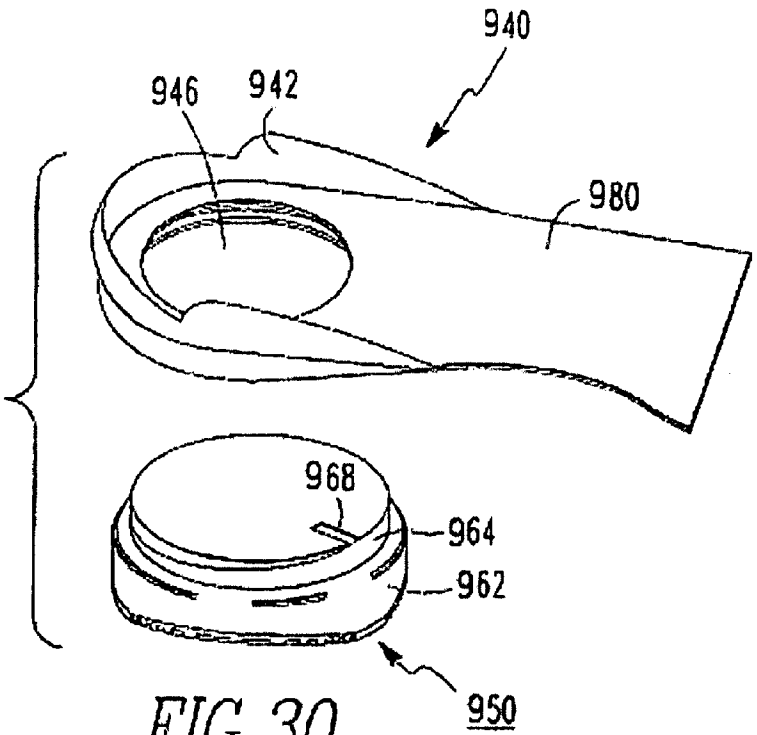
FIG. 30 is another exploded isometric view of the heel support and rear sole of FIG. 29.

The upper midsole portion 964 includes a spiral groove 968, as shown in FIGS. 29–31, that allows the rear sole to be screwed into the heel support. As shown in FIG. 29, a portion of the rim of the heel support is cut away at 970. The rear sole is screwed into the heel support by aligning the top of the spiral groove with an edge 972 of the rim adjacent the cut-away portion. A sharp instrument (such as a slender screwdriver), inserted through the window 974 and into the top of the spiral groove 968 may aid in the start-up process. The rear sole is then simply rotated, and the rim engages the spiral groove of the rear sole to screw the upper midsole of the rear sole into the recess. Once fully inserted, the rear sole may be rotated freely within the recess by hand, albeit with desired resistance. When the rear sole is attached to the heel support, the optional anchors sink into the lower midsole portion of the rear sole due to the weight of the user to prevent rotation of the rear sole during use.

It should be noted that the configuration of the midsole 958, i.e., the upper midsole portion having a diameter equal to or slightly larger than that of the recess defined by the rim and a lower midsole portion having a diameter substantially equal to the diameter defined by the circular wall 944, further eliminates any vertical gapping problems from occurring between the wall of the heel support and the peripheral surface of the rear sole.

To assist in removing the rear sole from the heel support, the two windows 974, 976 (FIG. 29) are formed in the wall of the heel support, a first window 974 above the cut-away portion of the rim and a second window 976 positioned 180 degrees around the wall of the heel support from the first window. In addition, a small indention 978 is formed on the peripheral surface of the upper midsole portion 964 at a position 180 degrees from the point at which the spiral groove 968 intersects the bottom of the upper midsole portion 964, as shown in FIG. 31. To remove the rear sole from the heel support, the rear sole is rotated in the heel support until the small indention appears in the second window 976. At this point, the bottom of the spiral groove is aligned with the center of the cut-away portion. The user, again using a screwdriver or similar instrument inserted through the window 974 into the spiral groove 968, can then simply rotate the rear sole so that the rim of the heel support engages the spiral groove. The rear sole is then simply rotated to screw the rear sole out of the heel support.

Figure 32:
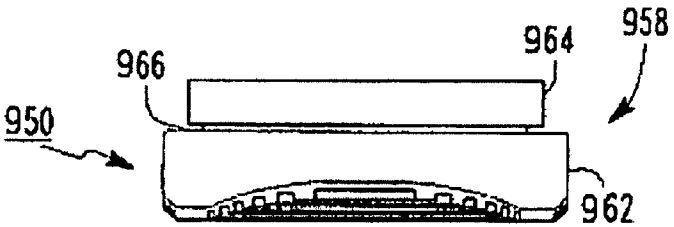
FIG. 32 is a side elevation view of another rear sole that can be used in the embodiment shown in FIG. 30.

It is not necessary to include a spiral groove in the rear sole for attaching and removing the rear sole from the heel support. As shown in FIG. 32, a rear sole 950 is similar to that shown in FIG. 31, but includes no spiral groove and no small indention. Because the upper portion 964 and lower portion 962 of the midsole 958 are made of a soft material, it can be press-fitted into the recess of the heel support until the rim 948 engages the groove 966.

Figure 28:
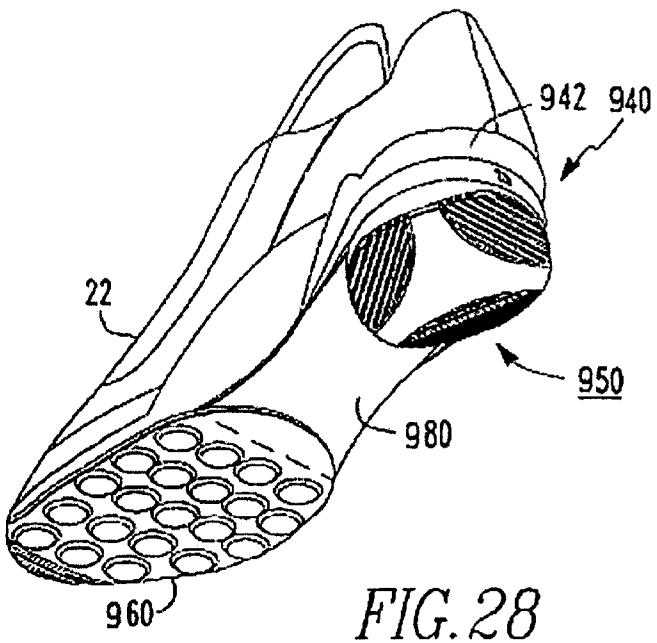
FIG. 28 is an isometric view of another embodiment of the shoe of the present invention.

As shown in FIGS. 28–30, the shoe of the present invention also preferably includes an arch bridge 980 attached to, and integral with, the heel support 940 to provide an even firmer support for the arch of the foot and for alleviating potential gapping problems where the wall of the heel support is adjacent the forward sole. The arch bridge 980 generally extends from the rear of the recess 946 (where it attaches to the heel counter 942 and side wall 944) to the ball of the foot and is attached to the upper 22 and forward sole 960 by gluing or other conventional methods. The arch bridge 980 also is preferably composed of the same material as the heel support and is made integral with the heel support 940 by molding. Such one-piece construction of the arch bridge together with the heel support solves another major problem, and that is the tendency of an athletic shoe of conventional "full body" arch construction to curl at the juncture of the hard heel support with the resilient forward sole.

Figure 33:
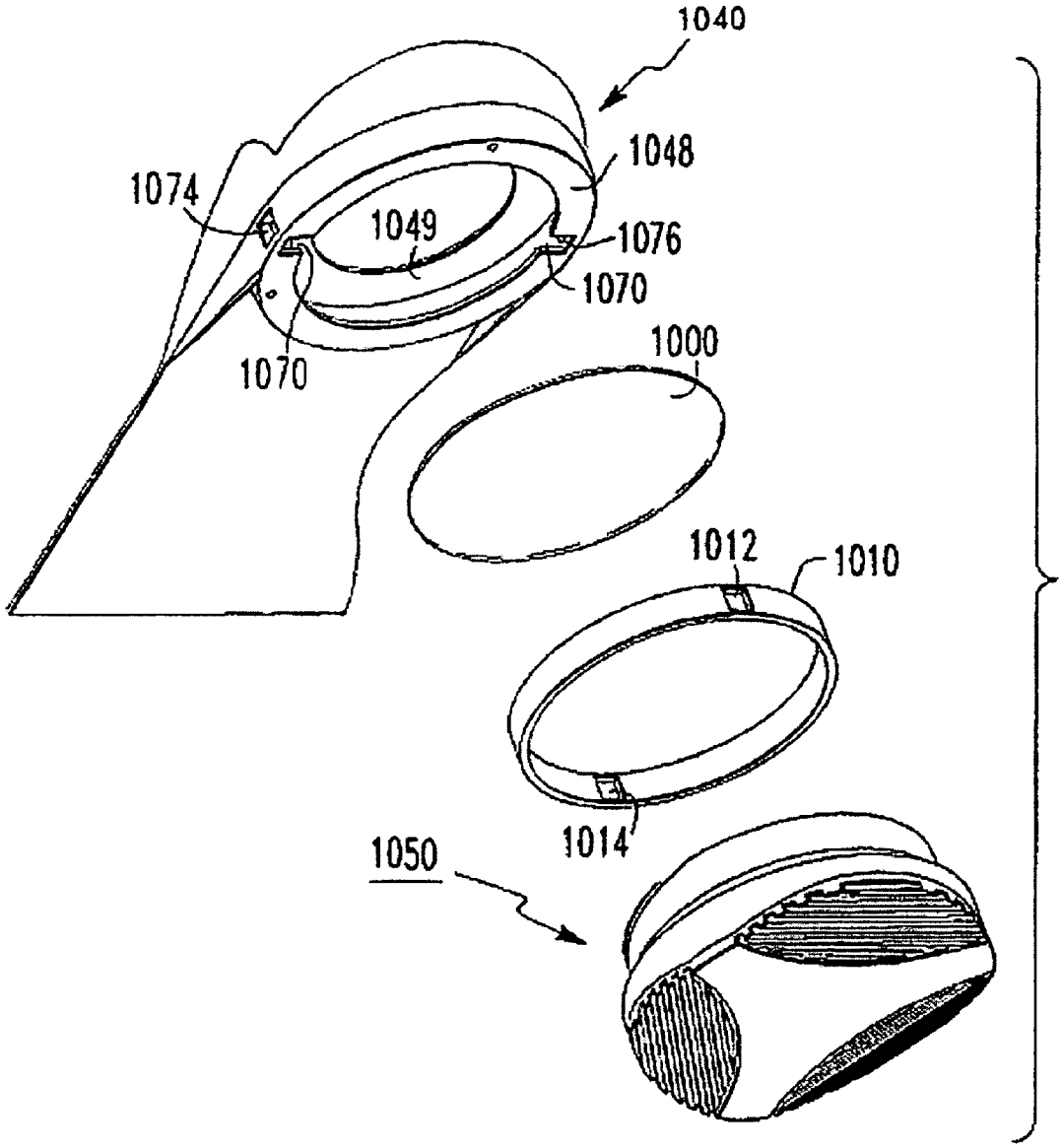
FIG. 33 is an exploded isometric view of a heel support, graphite insert, and rear sole for use in the shoe of the present invention.

Another embodiment for attaching the graphite insert is shown in FIG. 33. In this embodiment, the graphite insert 1000 is inserted through the bottom of the heel support 1040 so that the periphery of the graphite insert presses against the lower surface of an upper rim 1049 of the heel support. A plastic ring 1010 is also inserted in the recess between the graphite insert and the rim 1048. Such ring 1010 is flexible enough to allow it to be inserted into the heel support. The ring supports the periphery of the lower surface of the graphite insert. The rear sole 1050 is a screw-in type identical to the rear sole 950 shown in FIG. 31 except that it has a concave top surface to allow the graphite insert to flex during use.

As shown in FIG. 33, the rim 1048 of the heel support includes two cut-away portions at 1070 and windows 1074, 1076 to allow the graphite insert and the ring to be inserted into the recess of the heel support, in addition to allowing the rear sole to be screwed onto the heel support in the same manner as contemplated by FIGS. 29, 30 and 31. The ring 1010 also has windows 1012, 1014 that are aligned with the windows 1074, 1076 when the ring is inserted into the recess.

Figure 34:
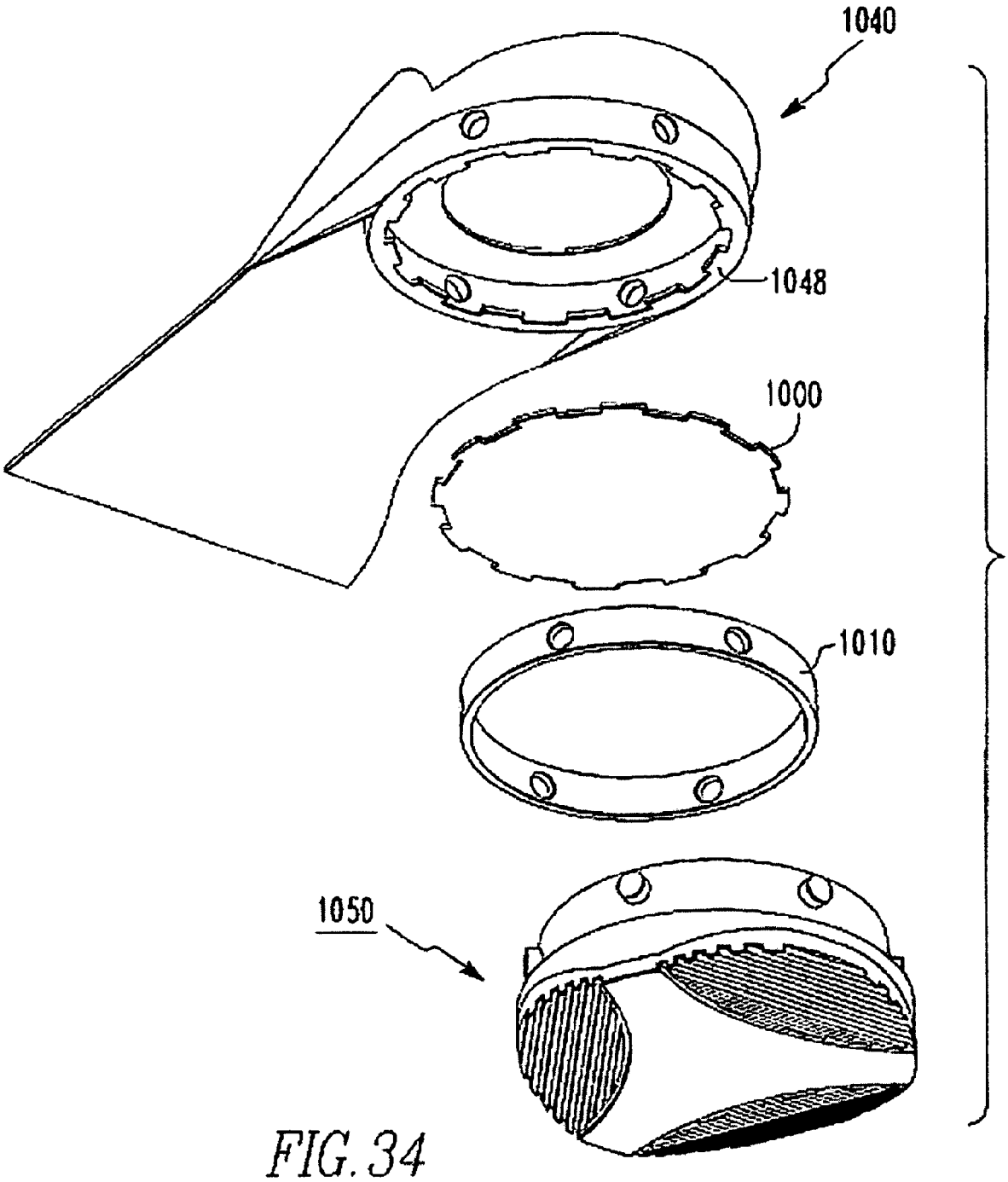
FIG. 34 is an exploded isometric view of another embodiment of a heel support, graphite insert, and rear sole for use in the shoe of the present invention.

Alternatively, the rim 1048 of the heel support and the graphite insert 1000 can be "gear-shaped", as shown in FIG. 34, to allow the graphite insert 1000 to be inserted into the heel support. Again, the ring 1010 is flexible enough to allow it to be inserted into the heel support.

Figure 36:
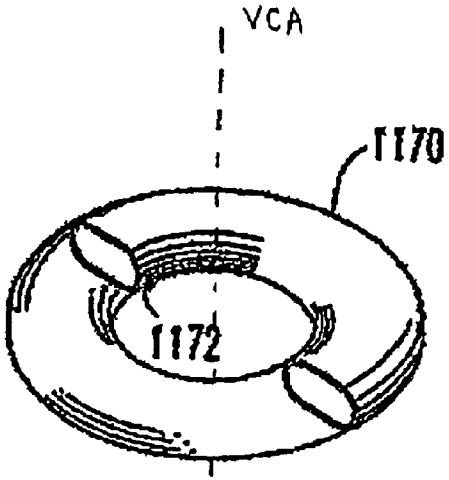
FIGS. 35–37 are views of a rear sole for use in the shoe of the present invention.
Figure 37:
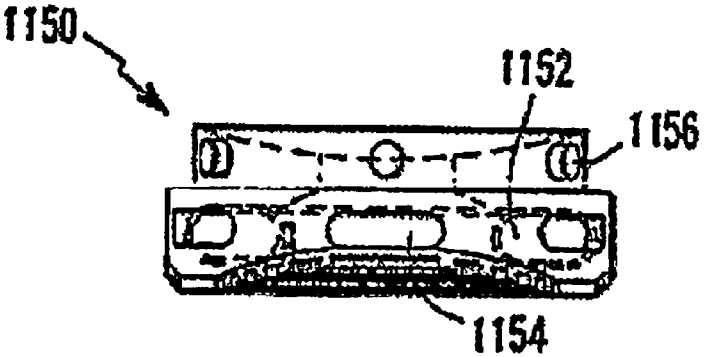
Figure 35:
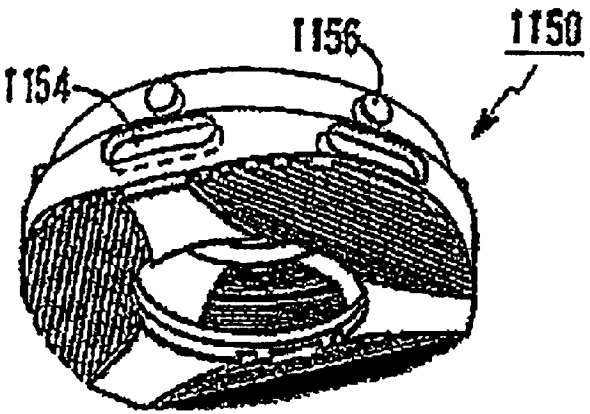

If additional cushioning is desired, the rear sole can be modified as shown in FIGS. 35–37. In this embodiment, a "doughnut-shaped" void 1152 is created in the middle of a rear sole 1150 to support an air-filled cushion 1170 similar in shape to an inner tube for a tire. In addition, several voids 1154 are formed around the periphery of the rear sole to reduce the weight of the rear sole and better exploit the cushioning properties of the air-filled cushion 1170 when the shoe strikes the ground during use. The voids are preferably positioned directly below the knobs 1156 to cushion the force transmitted from the heel support to the knobs. The air cushion 1170 may include a valve 1172 for inflating and deflating the cushion.

As shown in FIG. 36, cushion 1170 has an interior chamber, a generally flat top and bottom, and a pair of curved sidewalls connecting the top and bottom. The thickness between the interior chamber and the exterior surface of the cushion is substantially uniform in cross section. The outer-most curved sidewall (i.e., the sidewall furthest away from a vertical central axis (VCA) passing through the center of the doughnut) has exterior and interior surfaces that are curved and generally circular-shaped across the width of the cushion. The exterior and interior surfaces of the outer-most curved wall are also curved along the height of the cushion to form an arc of a circle. The vertical curves of the interior and exterior surfaces of the outer-most curved sidewall each have an apex where the slope of the curve is zero that lie in a single plane perpendicular to the vertical central axis.

The vertical curve of the exterior surface of the outer-most curved wall converges in a direction away from the vertical central axis and forms a convex wall. The vertical curve of the interior surface of the outer-most curved wall converges in a direction away from the vertical central axis and forms a concave wall. As shown in FIG. 36, the interior curved surface is symmetrical relative to a horizontal plane perpendicular to the vertical central axis. Owing to the curvature of the interior surface, the interior chamber of cushion 1170 has a horizontal cross section that is variable along a middle portion of the height of cushion 1170.

The inner-most curved sidewall (i.e., the sidewall closest to the vertical central axis of cushion 1170) is curved like the outer-most curved sidewall except that the interior and exterior surfaces converge toward the vertical central axis.

The graphite insert is not limited to a circular graphite insert and can be adapted to conform to the shape of the rear sole. In addition, the graphite insert may be concave or convex in shape and may include cut-out portions such as those in the graphite insert 1000 shown in FIG. 38, to provide additional spring. The graphite insert also need not be used only In conjunction with a detachable rear sole, but can be used with permanently attached rear soles as well.

Figure 38:
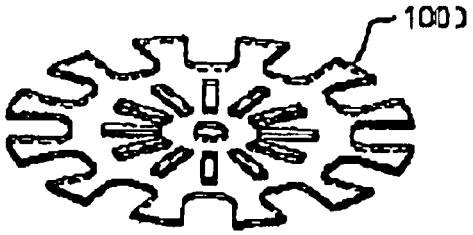
FIG. 38 is an isometric view of a graphite insert for use in the shoe of the present invention.

As shown in FIG. 38, insert 1000 has at least one hole therethrough. When used in conjunction with rear sole 1150, an opening will exist that extends upwardly from the bottom of rear sole 1150 to allow air communication between the bottom of the shoe and the open interior of the upper.

Figure 39:
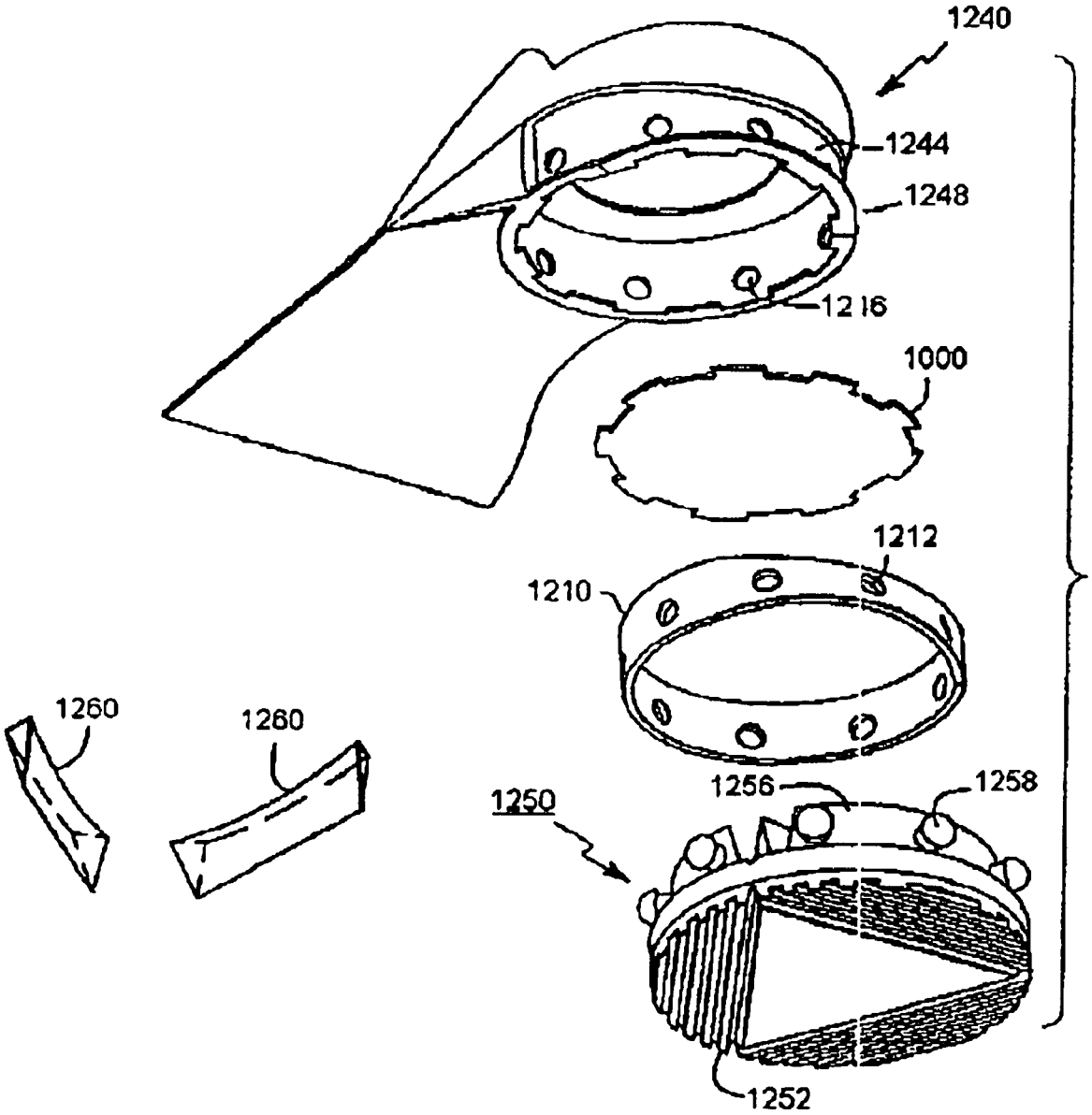
FIG. 39 is an exploded isometric view of another embodiment of the heel support, graphite insert, and rear sole for use in the shoe of the present invention.
Figure 40:
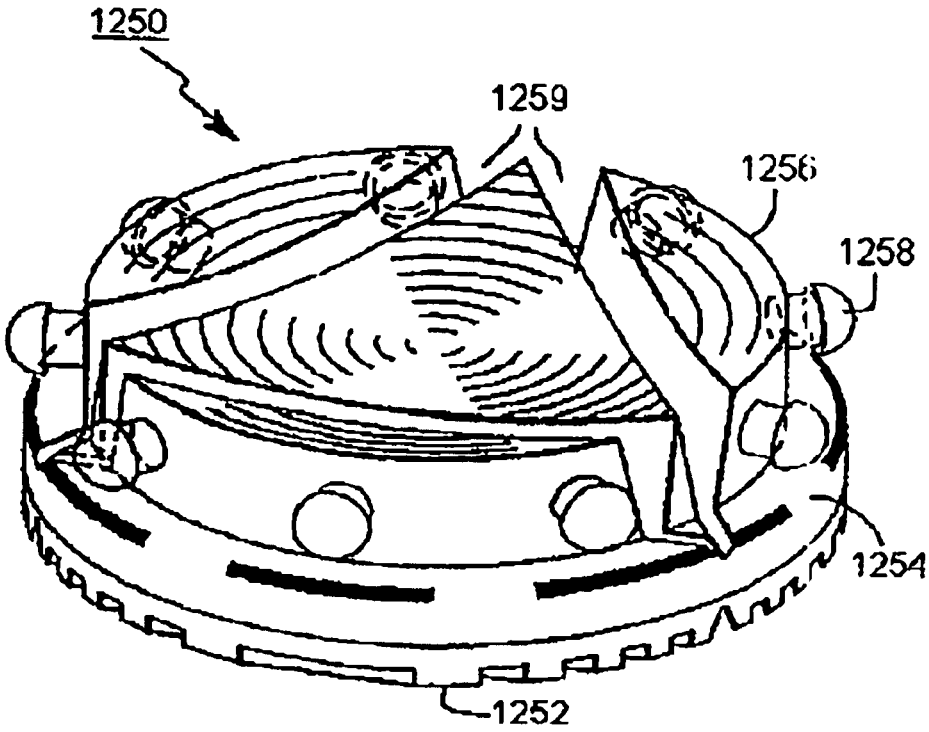
FIG. 40 is an isometric view of the rear sole of FIG. 39.
Figure 41:
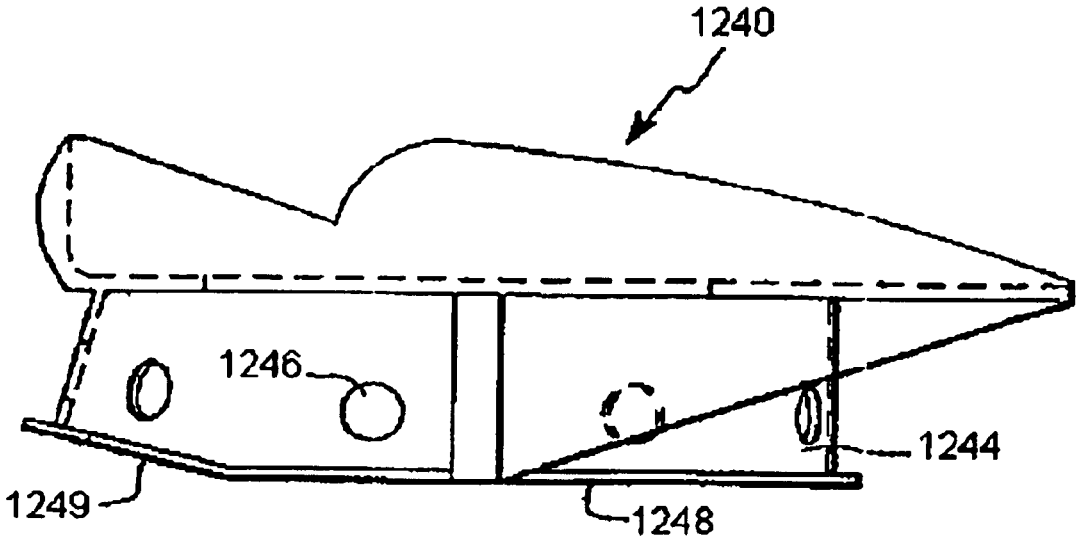
FIG. 41 is a side elevation view of the heel support of FIG. 39.

Another embodiment is shown in FIGS. 39–41 and includes a heel support 1240, a graphite insert 1000, a ring 1210, and a rear sole 1250. As shown in FIG. 40, the rear sole 1250 includes a substantially planar ground-engaging surface 1252, a lower midsole portion 1254, and an upper midsole portion 1256. A plurality of knobs 1258 having bulbous end portions are formed around the periphery of the upper midsole portion 1256. In addition, three voids 1259 are formed in the upper midsole portion 1258 and a portion of the lower midsole portion 1254.

As shown in FIG. 41, the heel support 1240 includes a downwardly extending wall 1244 that contains a plurality of openings 1246 for receiving the knobs 1258. The heel support 1240 also includes a rim 1248 having a rearward bent portion 1249. Given this configuration, the ring 1210, which also has a plurality of openings 1212 that are aligned with the openings 1246 of the heel support, and the graphite insert 1000 are shaped accordingly to fit within the recess of the heel support.

The graphite insert 1000 and the ring 1210 are inserted into the recess of the heel support and the rear sole 1250 is press-fitted into the recess so that the knobs 1258 of the rear sole engage the openings 1246 formed in the wall 1244 of the heel support. Since the rim of the heel support is bent, the portion of the rear sole adjacent the bent rim will also be bent upwardly to effectively create a beveled edge on the ground-engaging surface. The voids 1259 created in the rear sole allow the rear sole easily to be bent to conform to the shape of the bent rim. Wedges 1260 may be inserted into the voids of the rear sole that are not adjacent to the bent rim to provide lateral support.

It will be apparent to those skilled in the art that various modifications and variations can be made in the system of the present invention without departing from the scope or spirit of the invention. Thus, it is intended that the present invention cover the modifications and variations of this invention provided they come within the scope of the claims and their equivalents.

I claim:

1. A shoe comprising:

a bottom;

a major longitudinal axis;

an upper;

a sole including an outsole and a midsole, the sole being beneath at least a portion of the upper;

a plate having an upper surface, a lower surface, an interior portion and peripheral portions, the plate extending under at least a substantial portion of the area occupied by the upper, at least one of the peripheral portions of the plate being proximate at least one of a medial side of the shoe a lateral side of the shoe and a rear of the shoe, the interior portion of the plate being positioned over a void and exposed to the void, at least a portion of the plate capable of being deflected in a direction substantially perpendicular to the major longitudinal axis of the shoe;

at least one opening in the shoe, the opening being in air communication with the void to expose the interior portion of the plate from outside the shoe through the opening and the void; and at least one rib integral with at least a portion of the lower surface of the plate, at least a portion of the at least one rib being exposed to and visible from outside the shoe.

2. The shoe of claim 1, further including at least one wall proximate at least a portion of the peripheral portions of the plate and extending in an upwardly direction from the plate, the at least one wall being made of the same material as the plate and being integral with the plate.

3. The shoe of claim 2, wherein the at least one wall integral with the plate is visible from at least one of the medial side of the shoe, the lateral side of the shoe, and the rear of the shoe.

4. The shoe of claim 2, wherein the upper includes an arch region, the shoe further including an arch bridge integral with the plate extending from a position proximate a forward portion of the plate, forward beneath at least a portion of the arch region of the upper.

5. The shoe of claim 4, further including at least one wall integral with the arch bridge proximate at least one of the medial side of the shoe and the lateral side of the shoe and extending in an upwardly direction from the arch bridge, the at least one wall of the arch bridge being made of the same material as the plate and being visible at least in part from outside the shoe.

6. The shoe of claim 5, wherein the at least one upwardly extending wall of the arch bridge is integral with the at least one upwardly extending wall of the plate.

7. The shoe of claim 1, wherein the upper includes an arch region, the shoe further including an arch bridge integral with the plate extending from a position proximate a forward portion of the plate, forward beneath at least a portion of the arch region of the upper.

8. The shoe of claim 7, wherein the arch bridge has a lower surface that is at least in part visible from outside the shoe.

9. The shoe of claim 7, wherein the arch bridge has a lower surface that is at least in part visible from the bottom of the shoe.

10. The shoe of claim 1, wherein the upper includes an arch region, the bottom of the shoe having an elevated portion extending from the medial side of the shoe to the lateral side of the shoe below at least a portion of the arch region of the upper that is non-ground-engaging.

11. The shoe of claim 10, wherein the elevated portion extends below at least a substantial portion of the arch region of the upper.

12. The shoe of claim 10, wherein the elevated portion extends below substantially the entire arch region of the upper.

13. The shoe of claim 10, wherein at least a forward portion of the elevated portion proximate the medial side of the shoe is inclined upwardly in a direction toward the rear of the shoe.

14. The shoe of claim 10, wherein at least a rearward portion of the elevated portion proximate the medial side of the shoe is inclined upwardly in a direction toward a front of the shoe.

15. The shoe of claim 10, wherein the sole includes a ground-engaging portion formed of a first material, at least a portion of the elevated portion of the bottom below the arch region being formed of a second material different from the first material.

16. The shoe of claim 7, wherein the arch bridge has a lower surface that is at least in part visible from outside the shoe, the lower surface of a peripheral region of the arch bridge along the lateral side of the shoe being approximately planar with the lower surface of the plate for at least a substantial portion of the full extension of the arch bridge as measured along an axis that is parallel with the major longitudinal axis of the shoe.

17. The shoe of claim 1, wherein the at least one rib is visible at least in part from outside the shoe through the opening and the void.

18. The shoe of claim 1, wherein the at least one rib includes a plurality of ribs.

19. The shoe of claim 1, wherein the interior portion of the plate is capable of being deflected relative to at least a portion of the peripheral portions of the plate in a direction substantially perpendicular to the major longitudinal axis of the shoe.

20. The shoe of claim 1, wherein one of the peripheral portions of the plate is proximate the medial side of the shoe and one of the peripheral portions of the plate is proximate the lateral side of the shoe.

21. The shoe of claim 1, wherein one of the peripheral portions of the plate is proximate the medial side of the shoe, one of the peripheral portions of the plate is proximate the lateral side of the shoe end one of the peripheral portions of the plate is proximate the rear of the shoe.

22. The shoe of claim 1, wherein the major longitudinal axis intersects the rear of the shoe at a point, the portion of the peripheral portions proximate the rear of the shoe being proximate the point.

23. The shoe of claim 1, wherein the plate portion proximate the medial side of the shoe end the plate portion proximate the lateral side of the shoe each contact a portion of a wall, each of the wall portions extending in at least one of an upwardly and a downwardly direction from the plate, the wall portion contacted by the plate portion proximate the medial side of the shoe being located on the medial side of the shoe and being exposed to and visible from the medial side of the shoe, the wall portion contacted by the plate portion proximate the lateral side of the shoe being located on the lateral side of the shoe and being exposed to and visible from the lateral side of the shoe, the plate and the wall portions each being made of a plastic material.

24. The shoe of claim 23, wherein the wall portions are integrally formed with the plate.

25. The shoe of claim 23, wherein the plate portion proximate the rear of the shoe contacts a portion of a wall, the wall portion contacted by the plate portion proximate the rear of the shoe extending in at least one of an upwardly and a downwardly direction from the plate and being exposed to and visible from the rear of the shoe, the plate and the wall portions each being made of a plastic material.

26. The shoe of claim 25, wherein the wall portions are integrally formed with the plate and with each other.

27. The shoe of claim 1, wherein the interior portion of the plate is positioned at least in part beneath the calcaneus of the wearer of the shoe.

28. The shoe of claim 27, wherein the interior portion of the plate that is positioned at least in part beneath the calcaneus of the wearer is positioned at least in part beneath the approximate center of the calcaneus of the wearer of the shoe.

29. The shoe of claim 1, wherein the upper includes a heel region, the plate extending under at least a majority of the area occupied by the heel region.

30. The shoe of claim 1, wherein the upper includes a heel region, the plate extending under at least two-thirds of the area occupied by the heel region.

31. The shoe of claim 30, wherein the plate extends under substantially the entire area occupied by the heel region.

32. The shoe of claim 1, wherein the upper includes a heel region, the plate extending under substantially the entire area occupied by the heel region.

33. The shoe of claim 24, wherein the upper includes a heel region, the plate extending under substantially the entire area occupied by the heel region.

34. The shoe of claim 26, wherein the upper includes a heel region, the plate extending under substantially the entire area occupied by the heel region.

35. The shoe of claim 1, wherein the upper includes a heel region and the sole includes a rear sole, the rear sole including a vertical central axis passing through the bottom of the shoe and the heel region of the upper, the vertical central axis of the rear sole being generally perpendicular to the major longitudinal axis of the shoe and being completely surrounded by at east a portion of the plate.

36. The shoe of claim 1, wherein the sole includes a rear sole, the rear sole having a width from the medial side of the shoe to the lateral side of the shoe, the plate forming a support bridge across the width of the rear sole from a point proximate the medial side of the shoe to a point proximate the lateral side of the shoe.

37. The shoe of claim 1, wherein the interior portion of the plate is supported by a portion of the medial side of the shoe and a portion of the lateral side of the shoe.

38. The shoe of claim 1, wherein the sole includes a rear sole, the rear sole having a width from the medial side of the shoe to the lateral side of the shoe, the plate being adapted to support laterally the heel of a wearer across the entire width of the rear sole.

39. The shoe of claim 1, wherein the bottom of the shoe includes a ground-engaging portion, at least a portion of the plate being visible from the bottom of the shoe between at least two portions of the ground engaging portion of the bottom of the shoe.

40. The shoe of claim 39, wherein at least a portion of the at least one rib is visible from the bottom of the shoe between at least two portions of the ground engaging portion of the bottom of the shoe.

41. The shoe of claim 1, wherein the sole includes a rear sole that includes a ground-engaging portion, at least a portion of the at least one rib being visible from the bottom of the shoe between at least two portions of the ground engaging portion of the rear sole.

42. The shoe of claim 1, wherein the sole includes a rear sole, the rear sole having a bottom surface with a perimeter and a ground-engaging portion, the ground-engaging portion of the bottom surface including at least one substantially planar portion having an outer edge proximate a portion of the perimeter of the bottom surface of the rear sole, the at least one substantially planar portion being located proximate at least one of the medial side of the shoe and the lateral side of the shoe, the ground-engaging portion of the bottom surface including at least one portion non-planar with the at least one substantially planar portion, the at least one non-planar portion positioned proximate the perimeter of the bottom surface and inclined upwardly in a direction toward the perimeter of the bottom surface from another portion of the bottom surface, the at least one non-planar portion having an outer edge proximate a portion of the perimeter of the bottom surface and proximate a rearward portion of the rear sole, the portion of the perimeter of the bottom surface of the rear sole to which the outer edge of the at least one substantially planar portion is proximate and the portion of the perimeter of the bottom surface of the rear sole to which the outer edge of the at least one non-planar portion is proximate each having the shape of an arc of a circle, the circle having a diameter no greater than the maximum width of the bottom surface of the rear sole as measured on a line generally perpendicular to the major longitudinal axis of the shoe from a point on the medial side of the shoe to a point on the lateral side of the shoe.

43. The shoe of claim 1, wherein the sole includes a rear sole, the rear sole having a bottom surface with a perimeter and a center located beneath the approximate center of the calcaneus of the wearer of the shoe, the rear sole including a forward portion and an opposite rearward portion below the heel region of the upper, the bottom surface having at least two portions which are beveled in different directions away from the center of the rear sole, each of the beveled portions defining at least in part the perimeter of the rear sole.

44. The shoe of claim 43, wherein one of the at least two beveled portions is located at least in part in the forward portion of the rear sole and is oriented at least in part toward a front of the shoe.

45. The shoe of claim 43, wherein one of the at least two beveled portions is located at least in part in the rearward portion of the rear sole and is oriented at least in part toward the rear of the shoe.

46. The shoe of claim 43, wherein one of the at least two beveled portions is located at least in part in the forward portion or the rear sole and is oriented at least in part toward a front of the shoe and one of the at least two beveled portions is located at least in part in the rearward portion of the rear sole and is oriented at least in part toward the rear of the shoe.

47. The shoe of claim 1, wherein sole includes a rear sole, the rear sole having a perimeter and a bottom surface at least a portion of which is ground-engaging, the bottom surface of the rear sole including at least one substantially planar portion and at least two portions non-planar with the at least one substantially planar portion, the non-planar portions being positioned proximate the perimeter of the rear sole and separated from each other by other portions of the bottom surface of the rear sole, each of the non-planar portions being inclined upwardly from another portion of the bottom surface of the rear sole in a direction toward the perimeter of the rear sole, one of the at least two non-planar portions being proximate the rearward portion of the rear sole, and at least a portion of another of the at least two non-planar portions being proximate the forward portion of the rear sole.

48. The shoe of claim 1, wherein the upper includes an open interior, further including at least one opening extending upwardly from the bottom of the shoe and being in air communication with the open interior of the upper.

49. The shoe of claim 48, wherein the at least one opening extends through the plate.

50. The shoe of claim 1, further including a substantially air-tight enclosure located at least in part between a portion of the upper and a portion of the bottom of the shoe, the air-tight enclosure having a top, a bottom and a vertical central axis passing through the top and the bottom of the air-tight enclosure.

51. The shoe of claim 50, wherein the air-tight enclosure is an inflated cushion.

52. The shoe of claim 51, including a forward sole, the inflated cushion being located in the forward sole.

53. The shoe of claim 51, wherein the inflated cushion includes a bladder.

54. The shoe of claim 53, wherein the bladder is an air bladder.

55. The shoe of claim 50, wherein a portion of the air-tight enclosure is at least in part curved.

56. The shoe of claim 55, wherein the at least in part curved portion of the air-tight enclosure is curved in a direction substantially perpendicular to the vertical central axis.

57. The shoe of claim 55, wherein the at least in part curved portion of the air-tight enclosure is curved in a direction substantially parallel with the vertical central axis.

58. The shoe of claim 55, wherein the at least in part curved portion of the air-tight enclosure is curved in a direction substantially parallel with the vertical central axis and in a direction substantially perpendicular to the vertical central axis.

59. The shoe of claim 55, wherein the at least in part curved portion of the air-tight enclosure is arcuate in shape in a direction substantially perpendicular to the vertical central axis.

60. The shoe of claim 55, wherein the at least in part curved portion of the air-tight enclosure is arcuate in shape in a direction substantially parallel with the vertical central axis.

61. The shoe of claim 55, wherein the at least in part curved portion of the air-tight enclosure is arcuate in shape in a direction substantially parallel with the vertical central axis and in a direction substantially perpendicular to the vertical central axis.

62. The shoe of claim 50, wherein the air-tight enclosure is spaced apart from the plate during the entire gait cycle of the wearer.

63. The shoe of claim 50, wherein at least a portion of the top of the air-tight enclosure is in contact with a portion of the shoe.

64. The shoe of claim 50, wherein at least one of the top and the bottom of the air-tight enclosure has a portion that is generally flat and perpendicular to the vertical central axis.

65. The shoe of claim 50, wherein each of the top and the bottom of the air-tight enclosure has a portion that is generally flat and perpendicular to the vertical central axis.

66. The shoe at claim 50, wherein at least a portion of the bottom of the air-tight enclosure is generally flat and perpendicular to the vertical central axis.

67. The shoe of claim 50, wherein at least a portion of the top of the air-tight enclosure is generally flat and perpendicular to the vertical central axis.

68. The shoe of claim 50, wherein the sole includes a rear sole, each of the upper and the rear sole including a peripheral region, the air-tight enclosure being located at least in part between a portion of the peripheral region of the upper and a portion of the peripheral region of the rear sole.

* * * * *

UNITED STATES PATENT AND TRADEMARK OFFICE

CERTIFICATE OF CORRECTION

PATENT NO. : 6,966,130 B2 
APPLICATION NO. : 10/881390
DATED : November 22, 2005
INVENTOR(S) : David F. Meschan It is certified that error appears in the above-identified patent and that said Letters Patent is hereby corrected as shown below:

References Cited, Section (56):
Page 3, OTHER PUBLICATIONS, line 28: change "Mizuno 1987" to -- Mizuno 1988 --.

Column 18, line 36:
Change "shoe a" to -- shoe, a --.

Column 19, penultimate line:
Change "end" to -- and --.

Column 20:
Line 6: change "end" to -- and --; and
Line 60: change "east" to -- least --.

Column 22, line 1:
Change "or" to -- of --.

Signed and Sealed this

Twenty-fifth Day of July, 2006

JON W. DUDAS
*Director of the United States Patent and Trademark Office*